US006981900B2

(12) United States Patent
Sakurai et al.

(10) Patent No.: US 6,981,900 B2
(45) **Date of Patent: *Jan. 3, 2006**

(54) CONNECTOR AND A TERMINAL FITTING

(75) Inventors: Toshikazu Sakurai, Yokkaichi (JP); Yukihiro Fukatsu, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/809,009

(22) Filed: Mar. 25, 2004

(65) Prior Publication Data

US 2004/0192119 A1 Sep. 30, 2004

(30) Foreign Application Priority Data

Mar. 28, 2003 (JP) ..... 2003-091952

(51) Int. Cl.
*H01R 13/40* (2006.01)

(52) U.S. Cl. ..... 439/752.5; 439/595; 439/852

(58) Field of Classification Search ..... 439/752.5, 439/595, 744, 871, 852, 752
See application file for complete search history.

(56) References Cited

U.S. PATENT DOCUMENTS 5,281,175 A * 1/1994 Chupak et al. ..... 439/852
6,146,215 A 11/2000 Matsushita et al.
6,851,976 B2 * 2/2005 Ichida et al. ..... 439/595

FOREIGN PATENT DOCUMENTS

JP 2001-332334 11/2001

* cited by examiner

*Primary Examiner*—Tho D. Ta
*Assistant Examiner*—Felix O. Figueroa
(74) *Attorney, Agent, or Firm*—Gerald E. Hespos; Anthony J. Casella

(57) ABSTRACT

A terminal fitting (10) has a sidewall (14) and a stabilizer (30) is provided at the sidewall (14) for interfering with the entrance of a cavity (42) when the terminal fitting (10) upside down. The terminal fitting (10) has a posture-holding portion (35) at a sidewall (15) facing the stabilizer (30). The posture holding portion (35) contacts the inner wall of the cavity (42) if the terminal fitting (10) is mounted in a wrong posture. Thus, the terminal fitting (10) will not incline in the cavity (42). Accordingly a sufficient amount of interference of the stabilizer (30) with the edge is ensured, and erroneous insertion of the terminal fitting (10) is prevented.

17 Claims, 23 Drawing Sheets

CONNECTOR AND A TERMINAL FITTING

BACKGROUND OF THE INVENTION

1. Field of the Invention

The invention relates to a connector and to a terminal fitting therefor.

2. Description of the Related Art

Japanese Unexamined Patent Publication No. 2001-332334 and FIGS. 24(*a*) and 24(*b*) herein show terminal fittings with stabilizers. With reference to FIGS. 24(*a*) and 24(*b*) a known terminal fitting 200 has a stabilizer 210 provided on its outer periphery to assure that the terminal fitting 200 is mounted in a proper posture. A stabilizer insertion groove 230 is formed in an inner wall of a cavity 220 and extends along an inserting direction of the terminal fitting 200. The stabilizer 210 is inserted into the stabilizer insertion groove 230 when the terminal fitting 200 is oriented properly, and the stabilizer 210 and the groove 230 guide the terminal fitting 200 into the cavity 220. However, the stabilizer 210 contacts an opening edge at the entrance the cavity 220 if the terminal fitting 200 is oriented improperly (e. g. upside down), and hence the erroneous insertion is prevented.

The stabilizer 210 typically is formed near an end of a side surface of the terminal fitting 200 to avoid the interference with a retainer or the like of the connector. Accordingly, the stabilizer insertion groove 230 is formed at a corner of the cavity 230 to conform to the stabilizer 210. These positions present no problem if the terminal fitting 200 is oriented properly. However, a corner of the terminal fitting 200 will fall into the stabilizer insertion groove 230 if the terminal fitting 200 is mounted upside down and the terminal fitting 200 will incline (see FIG. 24(*b*)). In this situation, the amount of interference of the stabilizer 210 with the opening edge of the cavity 220 is reduced. As a result, the stabilizer 210 may bite into the upper surface of the cavity 220 sufficiently for the terminal fitting 200 to be inserted in a wrong posture.

The present invention was developed in view of the above problem and an object thereof is to improve the reliability of a preventing construction for preventing an erroneous insertion of a terminal fitting.

SUMMARY OF THE INVENTION

The invention relates to a connector that comprises a housing with at least one cavity for receiving terminal fitting. A guiding groove is formed at a corner of an inner wall of the cavity and extends substantially along an inserting direction of the terminal fitting. A side surface of the terminal fitting is formed with a stabilizer for engaging the guiding groove when the terminal fitting is inserted properly into the cavity. Thus, the stabilizer guides the insertion of the terminal fitting. However, the stabilizer interferes with an opening edge of the cavity diagonal to the guiding groove to prevent insertion when the terminal fitting is oriented improperly, e.g. upside-down. A posture holding portion is formed at a side surface of the terminal fitting other than the side surface that intersects a base end of the stabilizer. The posture holding portion bulges out towards the inner wall of the cavity at a position at or before the stabilizer with respect to the inserting direction of the terminal fitting. The posture holding portion contacts the inner wall of the cavity when the terminal fitting is inserted into the cavity in an improper orientation, e.g. upside down, to prevent the terminal fitting from falling into the guiding groove and becoming inclined.

As described above, a prior art terminal fitting that is inverted could fall partly into the guiding groove and hence the terminal fitting will incline. In this situation, the stabilizer may not interfere sufficiently with the opening edge of the cavity, and an erroneous insertion may occur. However, the terminal fitting of the subject invention has the posture holding portion. The posture holding portion contacts the inner wall of the cavity to hold the improperly oriented terminal fitting straight and to prevent the terminal fitting from being inclined. Thus, sufficient interference of the stabilizer with the opening edge of the cavity is ensured. The interference will prevent the terminal fitting from being inserted, and hence an operator will notice that the terminal fitting is in a wrong posture.

The disposition of the posture holding portion before the stabilizer prevents the terminal fitting from being inclined at an earlier timing than the stabilizer interferes with the opening edge of the cavity. Thus, the insertion of the terminal fitting in a wrong posture is prevented more reliably.

An escaping groove is formed in the inner wall of the cavity and extends substantially along the inserting direction of the terminal fitting for accommodating the posture holding portion when the terminal fitting is inserted properly. Accordingly, the posture holding portion of a properly oriented terminal fitting is accommodated in the escaping groove of the cavity and does not hinder the proper insertion.

The cavity preferably is a rectangular tube for receiving the terminal fitting. The posture holding portion can contact an inner wall of the cavity at a side adjacent the guiding groove when the terminal fitting is oriented improperly, e.g. upside down, with respect to the cavity. Accordingly, an inverted terminal fitting is unlikely to fall into the guiding groove because the posture holding portion contacts the inner wall at the side adjacent to the guiding groove. In addition, there is a high degree of freedom in locating the posture holding portion because no recess or projection such as the guiding groove is in the adjacent inner wall.

A front portion of the stabilizer relative to the inserting direction preferably is substantially normal to the inserting direction. Additionally, a rear portion of the stabilizer as seen in the inserting direction preferably is substantially rounded or slanted with respect to the inserting direction.

The terminal fitting preferably has a cut-away portion on one side for engaging a lock of the housing. The stabilizer preferably extends rearward from the cut-away portion.

The terminal fitting may have a locking projection on one side for engaging a lock of the housing. The height of the stabilizer preferably is larger than the height of the locking projection.

The terminal fitting preferably comprises a main portion. A leading end of a sidewall of the main portion may be embossed with an outwardly projecting bead that extends forward and back to reinforce the main portion.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
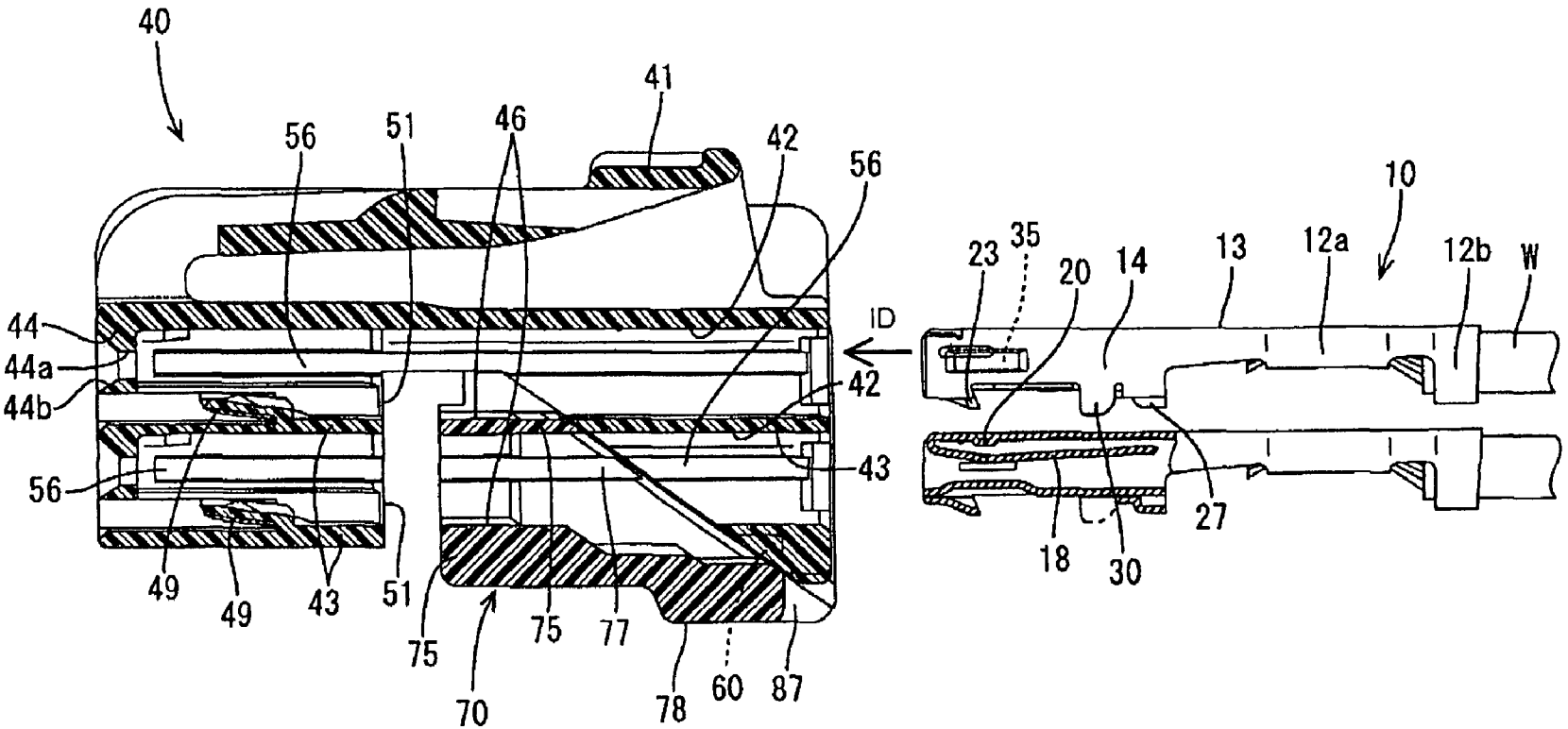
FIG. 1 is a section showing female terminal fittings and a female connector housing according to a first embodiment of the invention.

A female connector according to a first embodiment of the invention is illustrated in FIGS. 1 to 18. The female connector includes a female housing 40 that can accommodate female terminal fittings 10. The connector also includes a retainer 70 for doubly locking the female terminal fittings 10, as shown in FIG. 1. In the following description, a connection side with a mating connector (not shown), e.g. left side in FIG. 1, is referred to as front side.

Figure 2:
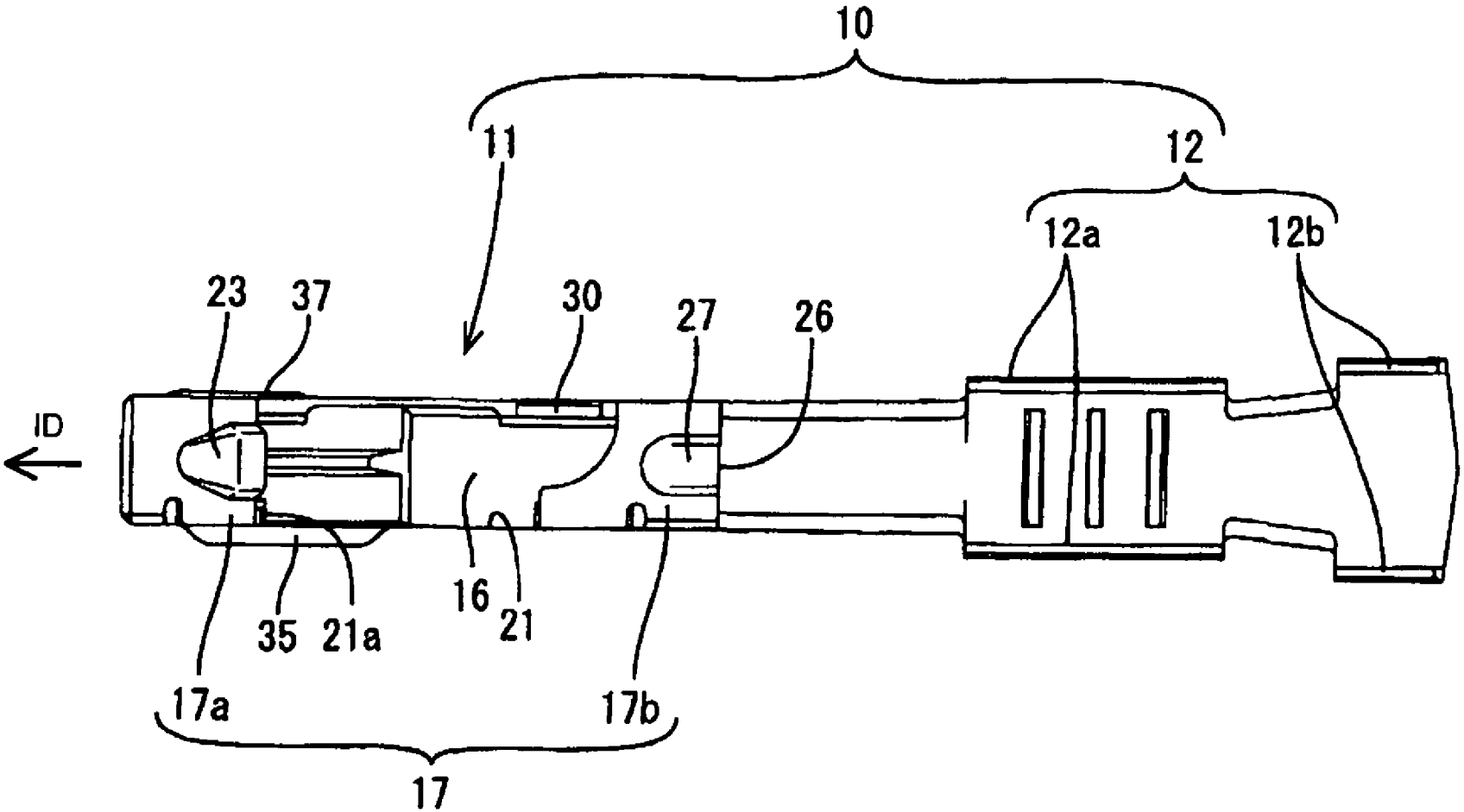
FIG. 2 is a bottom view of the female terminal fitting.
Figure 3:
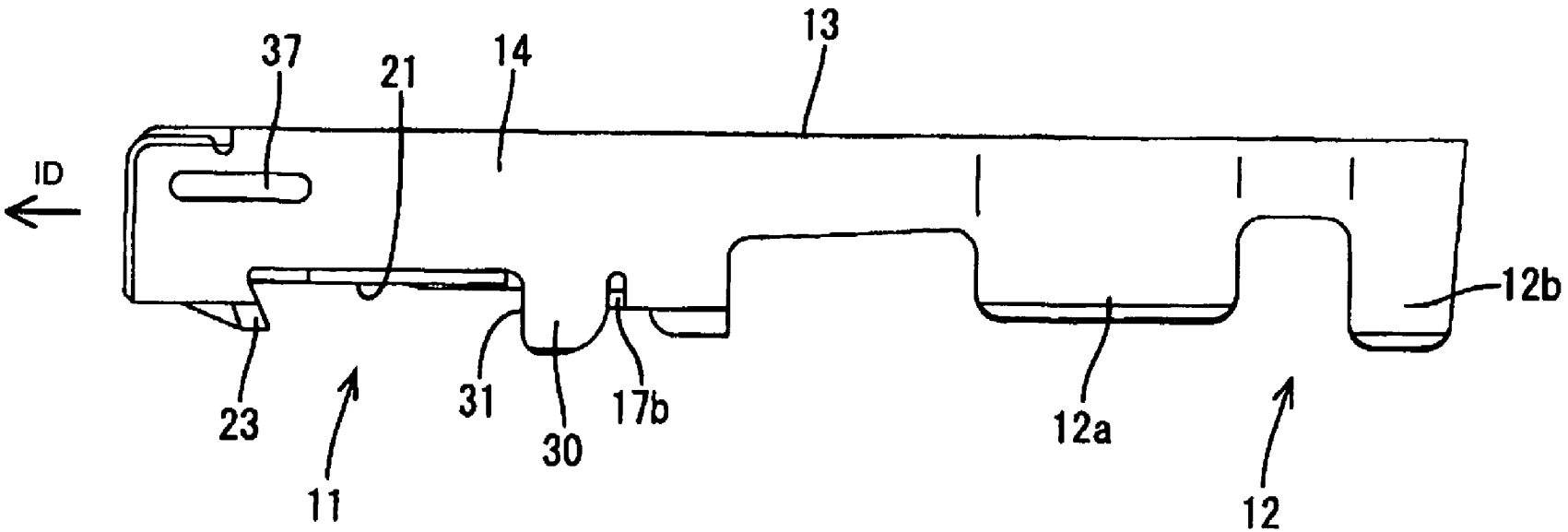
FIG. 3 is a side view of the female terminal fitting.
Figure 4:
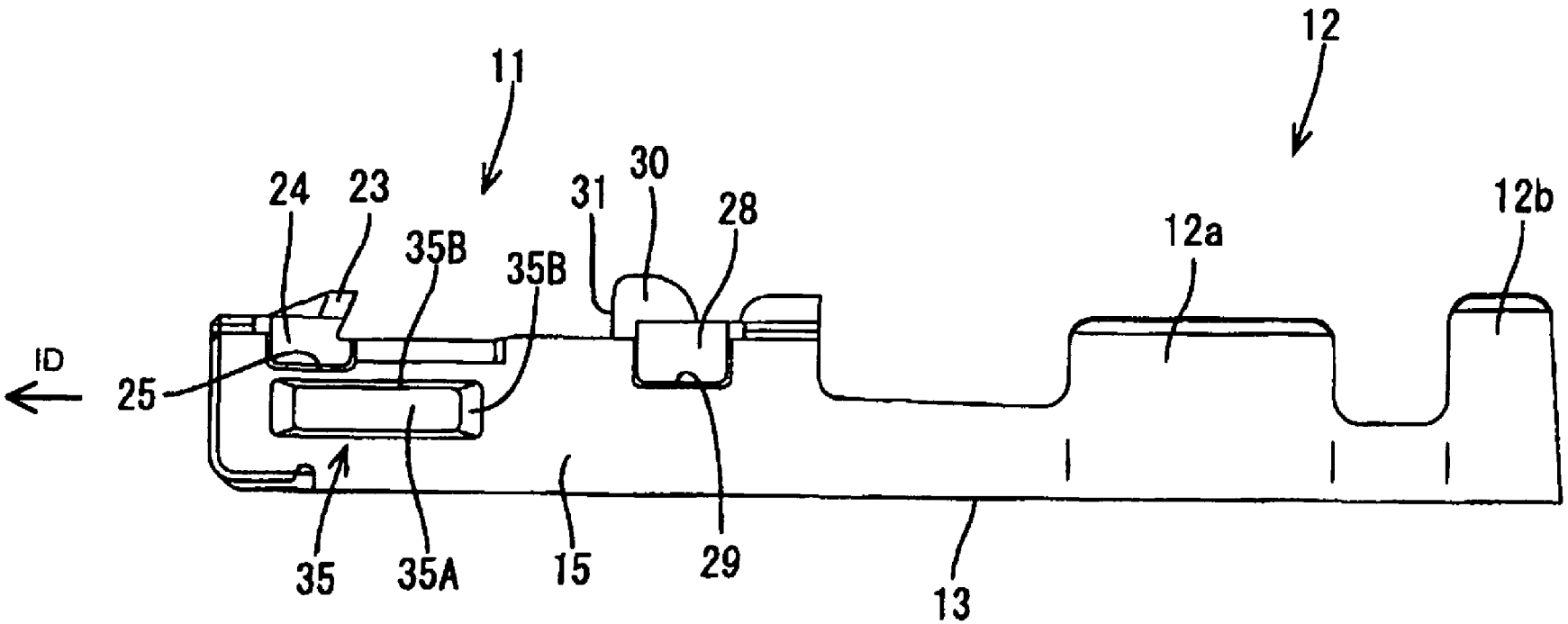
FIG. 4 is a side view of the female terminal fitting.
Figure 5:
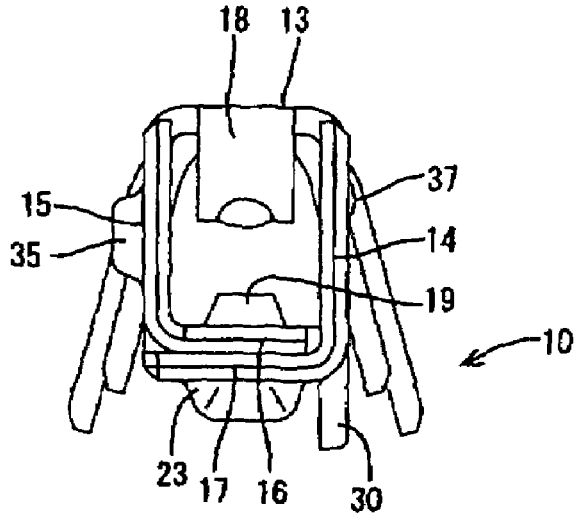
FIG. 5 is a front view of the female terminal fitting.

Each female terminal fitting 10 is formed by applying bending, folding, embossing and/or other processing to a conductive metallic plate that has been stamped or cut to have a specified shape. The terminal fitting 10, as shown in FIGS. 2 to 4, has a substantially box-shaped main portion 11 that is electrically connectable with a tab of a mating male terminal fitting (not shown). A wire-crimping portion 12 is behind the main portion and is configured for crimped, bent or folded connection with an end of a wire W. The crimping portion 12 has a pair of front crimping pieces and a pair of rear crimping pieces. The front crimping pieces define a wire barrel 12*a* to be crimped into connection with a core of the wire W and the rear crimping pieces define an insulation barrel 12*b* to be crimped into connection with an insulation coating of the wire W. The height of the wire barrel 12*a* in its crimped state exceeds the height of the main body 11. However, the height of the insulation barrel 12*b* in its crimped state is smaller than the height of the main body 11.

The main body 11 has a ceiling wall 13 that extends forward and back. Two sidewalls 14, 15 are bent down from the opposite lateral edges of the ceiling wall 13. A bottom wall 16 projects from the projecting end of the left side wall 15 of FIG. 5 and faces the ceiling wall 13. An outer wall 17 projects from the projecting end of the right side wall 14 of FIG. 5 and is placed on the outer side of the bottom wall 16. As shown in FIG. 1, a resilient contact piece 18 is folded to cantilever back at a moderate angle from the front end of the ceiling wall 13. The resilient contact piece 18 can be brought resiliently into contact with the tab of the mating male terminal fitting. The bottom wall 16 facing the resilient contact piece 18 is embossed in to form a receiving portion 19 that can squeezingly hold the tab in cooperation with the resilient contact piece 18. Further, the ceiling wall 13 is embossed in to form an excessive deformation preventing portion 20 that prevents excessive deformation of the resilient contact piece 18 by contacting the resilient contact piece 18 before the resilient contact piece 18 is deformed beyond its resiliency limit.

As shown in FIG. 2, the outer wall 17 is divided into a front part 17*a* and a rear part 17*b* by a cut-away portion 21 that extends over the entire width at a substantially longitudinal middle of the outer wall 17. As shown in FIG. 3, the rear end of the front part 17*a* of the outer wall 17 is embossed substantially in the widthwise middle to project down and out, thereby forming a locking projection 23. A front holding piece 24 is bent toward the ceiling wall 13 at the projecting abutted against the sidewall 14 of the front part 17*a* of the outer wall 17 as shown in FIG. 4. The front holding piece 24 is fit into a front holding groove 25 in the sidewall 15 to hold the front part 17*a*.

A locking step 26 is formed at the rear end of the main portion 11 for engaging a corresponding locking section 75 of the retainer 70. A protrusion 27 is embossed substantially in the widthwise middle of the rear end of the rear part 27*b* and projects substantially to the same height as the locking projection 23. The protrusion 27 also is engageable with the locking section 75. The protrusion 27 thus increases a depth of engagement with the locking section 75. A rear holding piece 28 is bent toward the ceiling wall 13 from the projecting end of the rear part 17*b* of the outer wall 17. The rear holding piece 28 fits into a rear holding groove 29 in the sidewall 15 to hold the rear part 17*b*.

A stabilizer 30 projects from the projecting end of the sidewall 14 in the same direction as the protrusion 27 and the locking projection 23. A stopper surface 31 is formed at the front surface of this stabilizer 30. The stopper surface 31 extends substantially straight along the vertical direction at an angle, and preferably substantially normal to an inserting direction ID of the female terminal fitting 10 into the female housing 40. The rear surface of the stabilizer 30 is arcuate or inclined with respect to the inserting direction ID. The stabilizer 30 extends from the cut-away portion 21 to the rear part 17*b* of the outer wall 17 and has a height that exceeds the heights of the locking projection 23 and the protrusion 27.

A leading end of the sidewall 14 is embossed to form a reinforcing bead 37 that projects out and in forward and backward directions.

Figure 6:
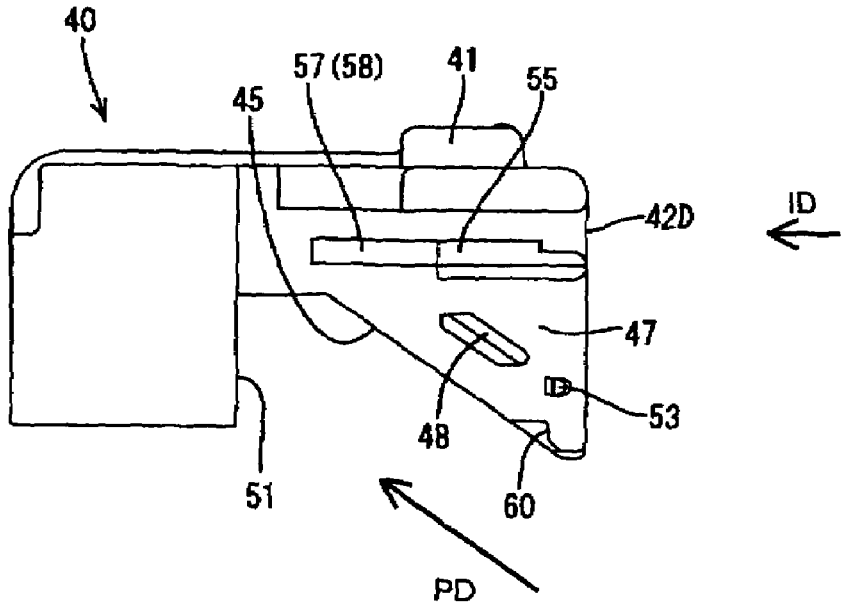
FIG. 6 is a side view of the female connector housing.
Figure 7:
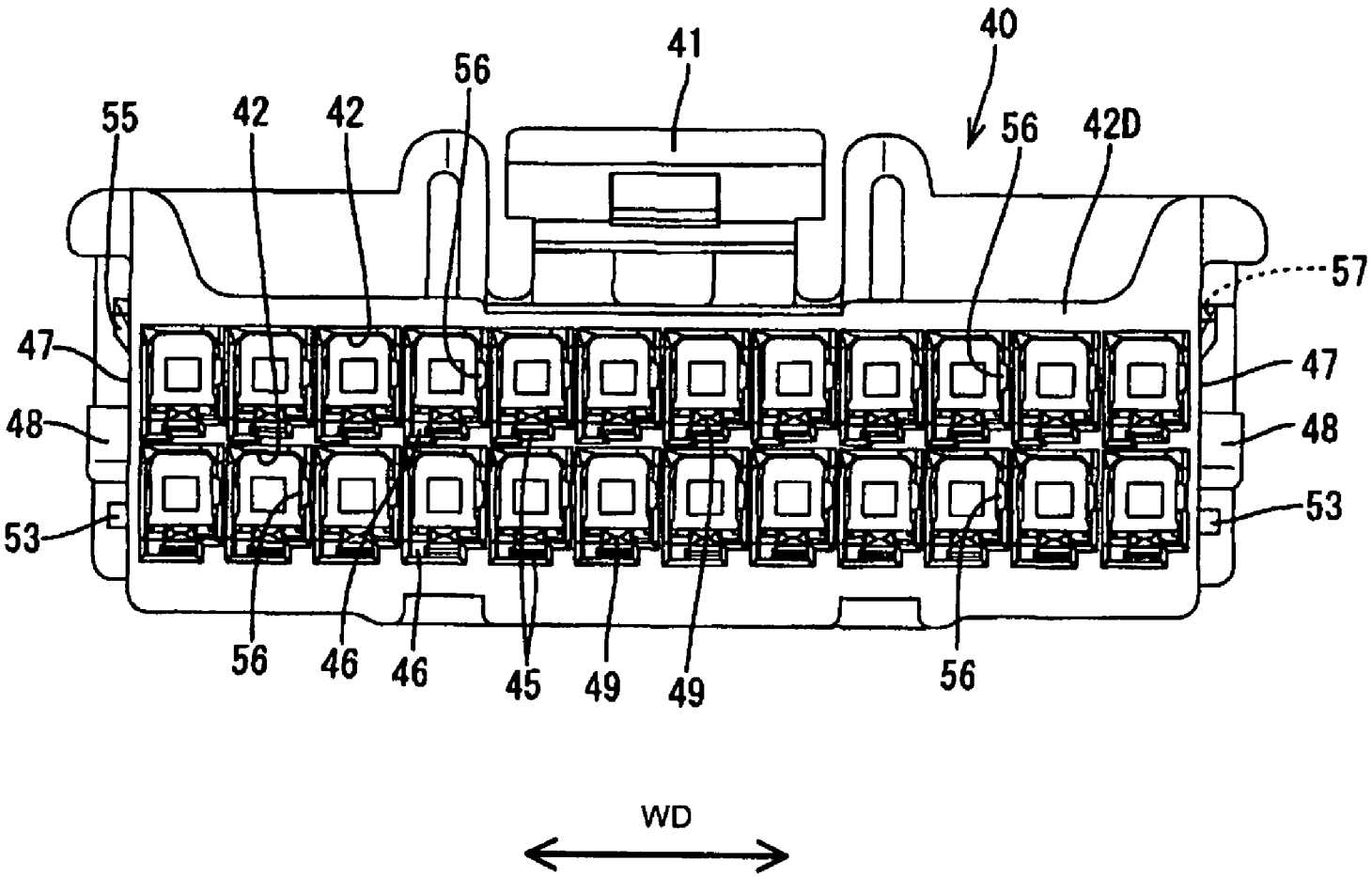
FIG. 7 is a rear view of the female connector housing.
Figure 8:
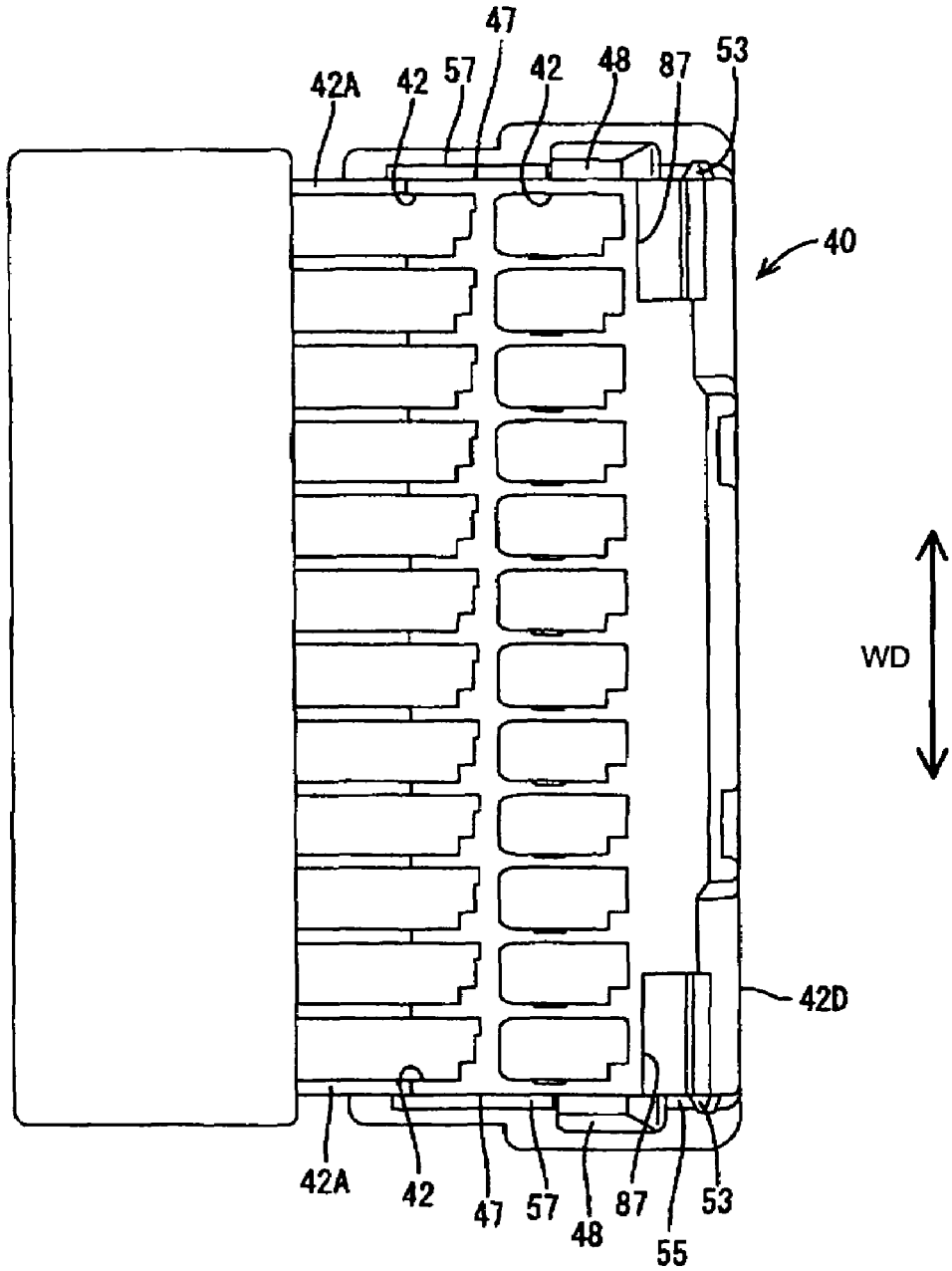
FIG. 8 is a bottom view of the female connector housing.

The female housing 40 is made e.g. of a synthetic resin and is substantially in the form of a wide and flat block, as shown in FIGS. 6 to 8. A lock arm 41 is formed on an upper surface of the female housing 40 for locking the female housing 40 and the mating male housing into each other.

Cavities 42 that are hollow in forward and backward directions are arranged substantially side by side in widthwise direction WD at upper and lower stages inside the female housing 40. The female terminal fittings 10 can be accommodated in each cavity 42 by being inserted from behind along the inserting direction ID. A lock 49 is provided at the front side of a bottom wall 43 of the cavity 42 for partly locking the female terminal fitting 10. The lock 49 cantilevers forward and the leading end of the lock 49 is resiliently displaceable up and down in a direction intersecting the inserting direction ID. The lock 49 is resiliently deformed substantially out and down as the female terminal fitting 10 passes above the lock 49, and is restored to engage the locking projection 23 of the female terminal fitting 10 after the passage, thereby functioning to lock the female terminal fitting 10 so as not to come out.

The female terminal fittings 10 engaged with the locks 49 are supported at front limit positions by a front wall 44 of the female housing 40. The front wall 44 has tab insertion holes 44*a* that permit the tabs of the mating male terminal fittings to enter the cavities 42 from the front. Tapered guiding surfaces 44*b* are formed at the front edges of the tab insertion holes 44 over substantially the entire periphery for smoothly guiding the entrance of the tabs.

Figure 16:
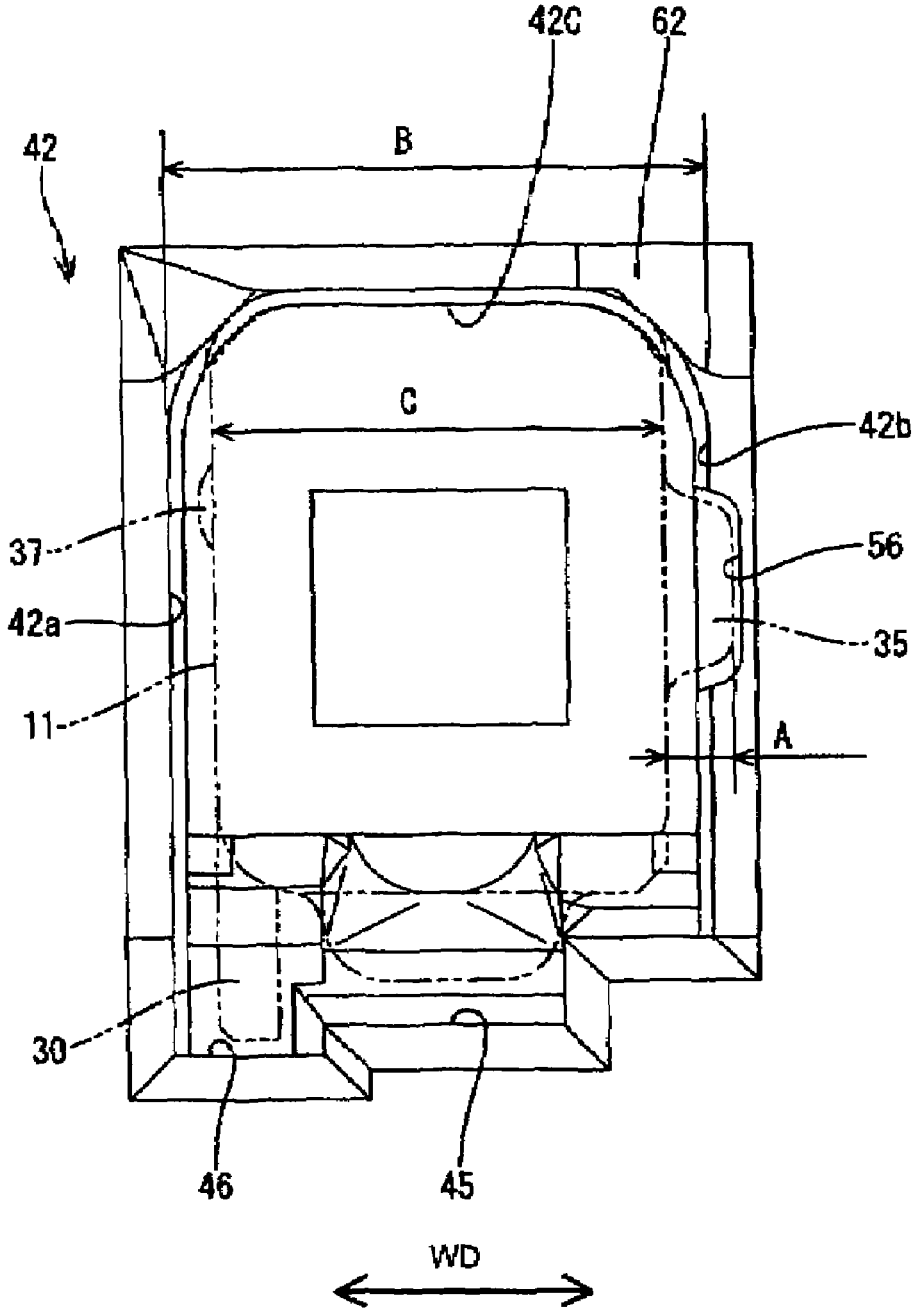
FIG. 16 is a section showing a state where the terminal fitting is inserted in a proper posture.

As shown in FIGS. 7 and 16, a protrusion insertion groove 45 is formed substantially in the widthwise middle of the bottom wall 43 of each cavity 42 over substantially the entire length for receiving the locking projection 23 and the protrusion 27. Similarly, a stabilizer insertion groove 46 is formed at the left corner of the bottom wall 43 in FIGS. 7 and 16 for receiving the stabilizer 30. The stabilizer insertion groove 46 extends substantially along the forward and backward directions of the female housing 40 and is open backward. The front end of the stabilizer insertion groove 46 is slightly behind a base end of the lock 49. The stabilizer insertion grooves 46 are deeper than the protrusion insertion grooves 45 at the upper stage, whereas the depths of the grooves 46, 45 are substantially equal at the lower stage.

A retainer mount hole 51 is formed in the bottom surface of the female housing 40 for receiving the retainer 70. Specifically, the retainer mount hole 51 is open in the bottom, left and right surfaces of the female housing 40. Accordingly, the retainer mount hole 51 is open at three sides.

The retainer mount hole 51 has a depth to expose the insides of the respective cavities 42 at the upper stage, and the ceiling surface of the retainer mount hole 51 is at a height substantially the middle of the cavities 42 at the upper stage. Thus, each cavity 42 at the lower stage is divided into front and rear sections over substantially the entire height, whereas each cavity 42 at the upper stage is divided into front and rear sections only up to a middle height thereof. In these divided sections, partition walls 42A partitioning the adjacent cavities 42 along widthwise direction WD are also substantially removed.

The front opening edges of all the cavities 42 at the inner part of the female housing 40 cut off by the retainer mount hole 51 extend vertically in a direction substantially normal to the inserting direction ID and normal to the widthwise direction. However, the rear opening edges of all the cavities 42 at the inner part of the female housing 40 cut off by the retainer mount hole 51 sloped down from the front side to the back side with respect to the inserting direction ID of the female terminal fittings 10.

Lock holes 60 are formed at opposite widthwise ends of the bottom end of the slanted surface of the retainer mount hole 51 in the female housing 40, as shown in FIG. 6.

The left and right surfaces of the female housing 40 are recessed slightly in areas above and behind side openings formed by the retainer mount hole 51 to form stepped surfaces 47 as shown in FIG. 6. A rib-shaped locking projection 48 is formed on each stepped surface 47 substantially along the inclined edge of the retainer mount hole 51. A push-in preventing projection 53 is aligned substantially with the back end of each locking projection 48.

Figure 11:
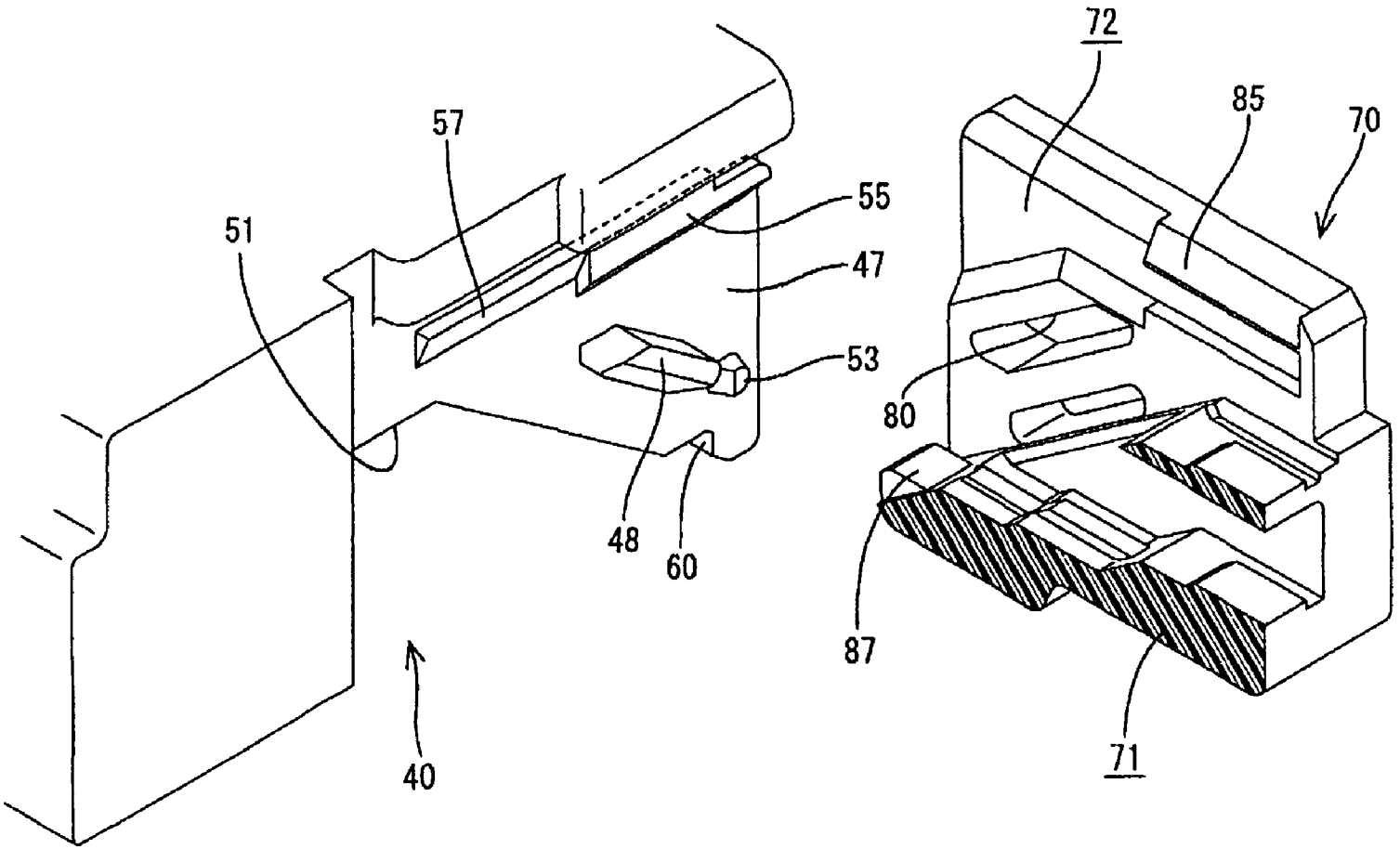
FIG. 11 is an exploded perspective view showing a fitting construction of the retainer and the female connector housing.

A shake preventing portion 55 projects above the locking projection 48 on each stepped surface 47 and extends substantially horizontally forward and backward along the insertion direction ID for preventing the retainer 70 at the full locking position (see FIG. 13) from shaking. Further, a catching piece 57 projects before each shake-preventing portion 55 so that an upper edge of the catching piece 57 is substantially continuous with the upper edge of the shake-preventing portion 55. As shown in FIG. 11, a slanted surface 58 is on the side of each catching piece 57 and slopes up towards the outer side, so that the locking claw 85 can move smoothly onto the catching piece 57.

Figure 9:
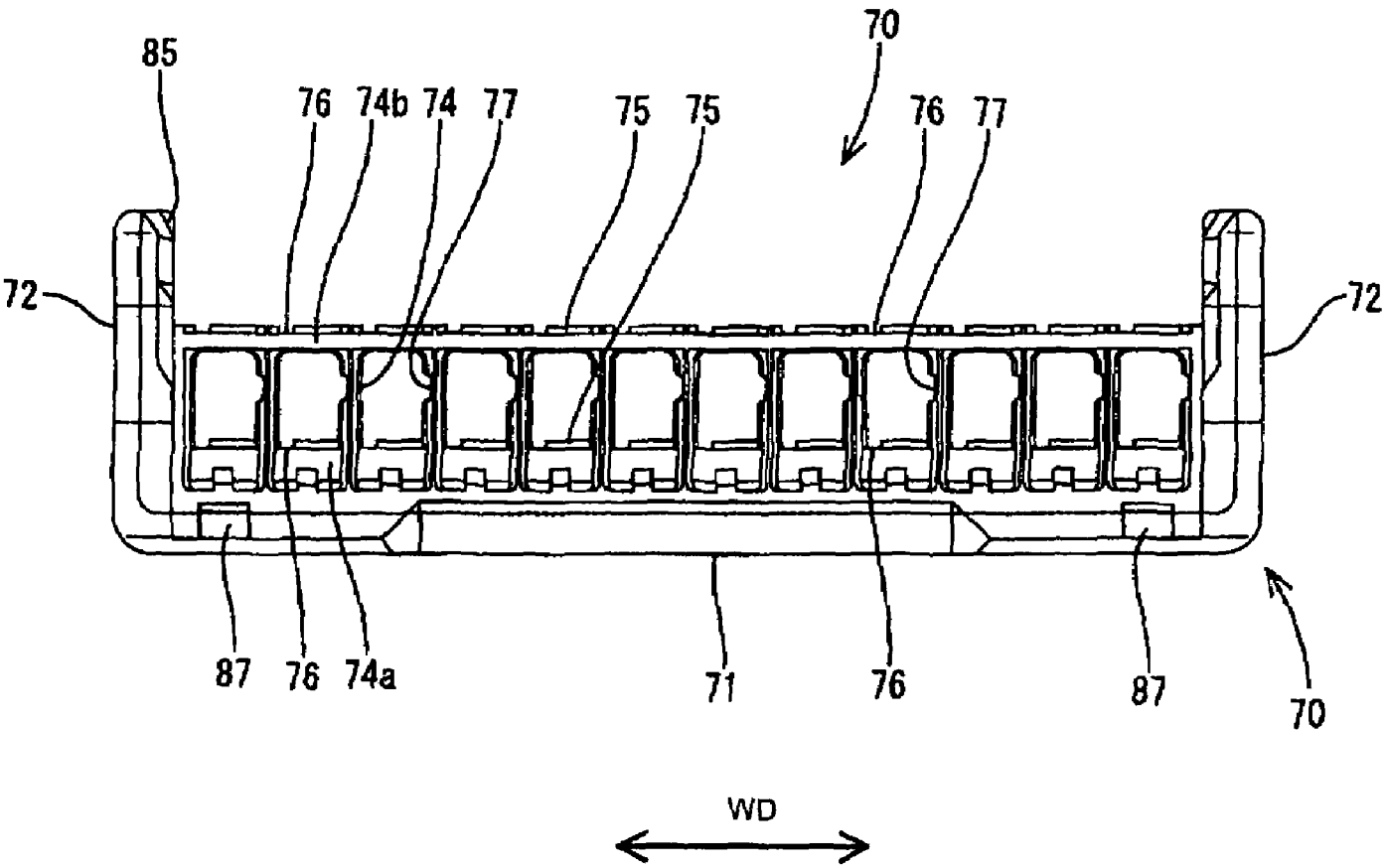
FIG. 9 is a front view of a retainer.
Figure 10:
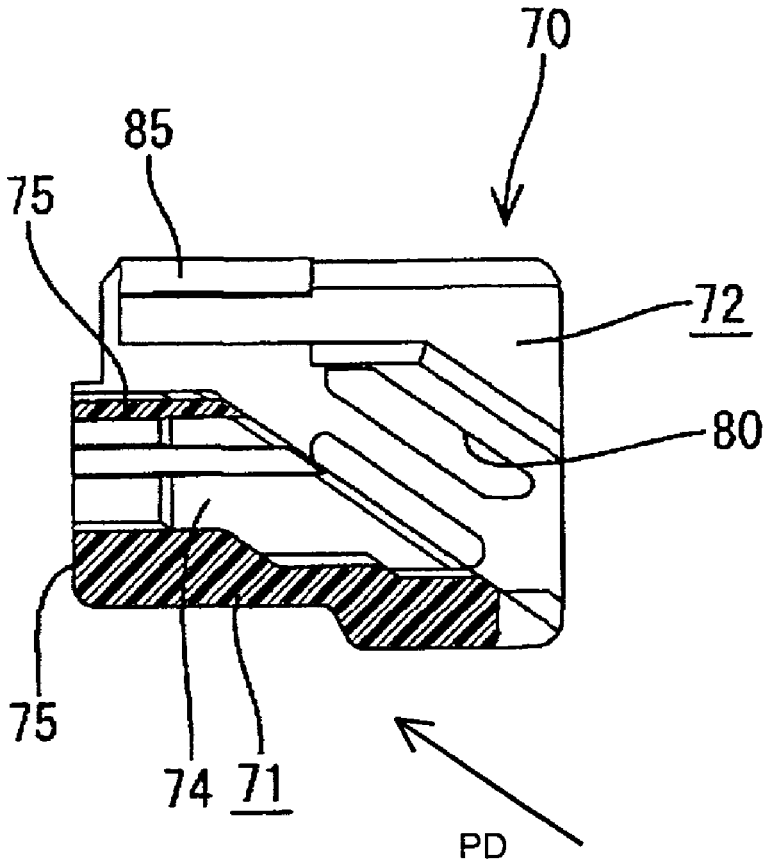
FIG. 10 is a section of the retainer.

The retainer 70 is formed e.g. of a synthetic resin similar to the female housing 40 and has a base 71 to be aligned substantially with and fit into the retainer mount hole 51. Side plates 72 bulge out at opposite widthwise ends of the base 71 as shown in FIGS. 9 to 11. The retainer 70 is displaceable between a partial locking position where insertion of the female terminal fittings 10 into the cavities 42 is permitted (see FIG. 1) and a full locking position where the female terminal fittings 10 are locked by the retainer 70 (see FIG. 15).

As shown in FIG. 9, the base 71 is formed with the same number of windows 74 as the cavities 42 at each stage of the female housing 40. The respective windows 74 are formed to be substantially alignable with the cavities 42 at the lower stage. As shown in FIG. 10, the front opening edges of the windows 74 extend vertically and substantially conform to the front opening edges of the cavities 42 divided into the front and rear sections by the retainer mount hole 51. The rear opening edges of the windows 74 are inclined as conform to the inclination of the rear opening edges of the divided cavities 42.

Figure 14:
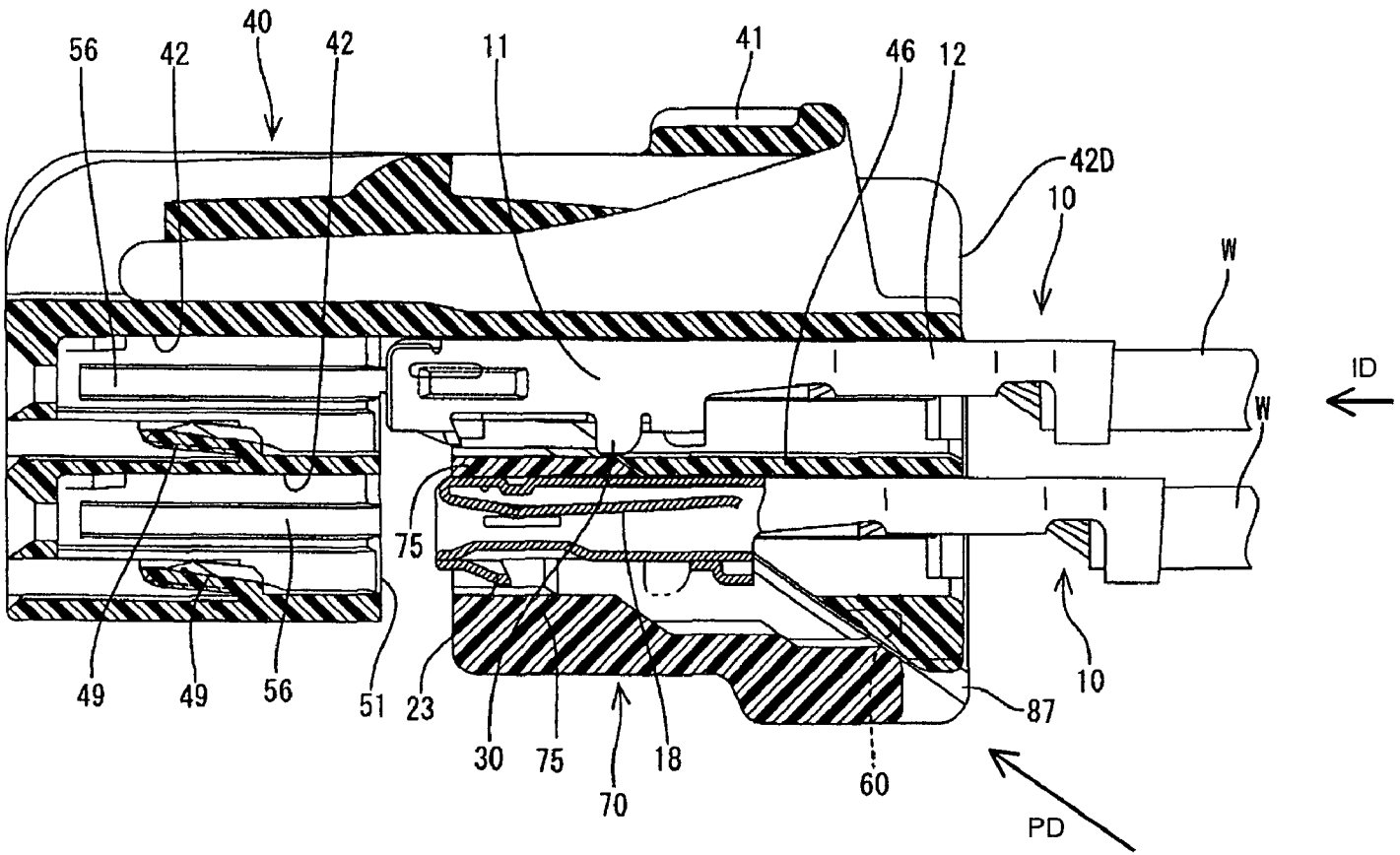
FIG. 14 is a section showing a state where the female terminal fittings are inserted into cavities.
Figure 15:
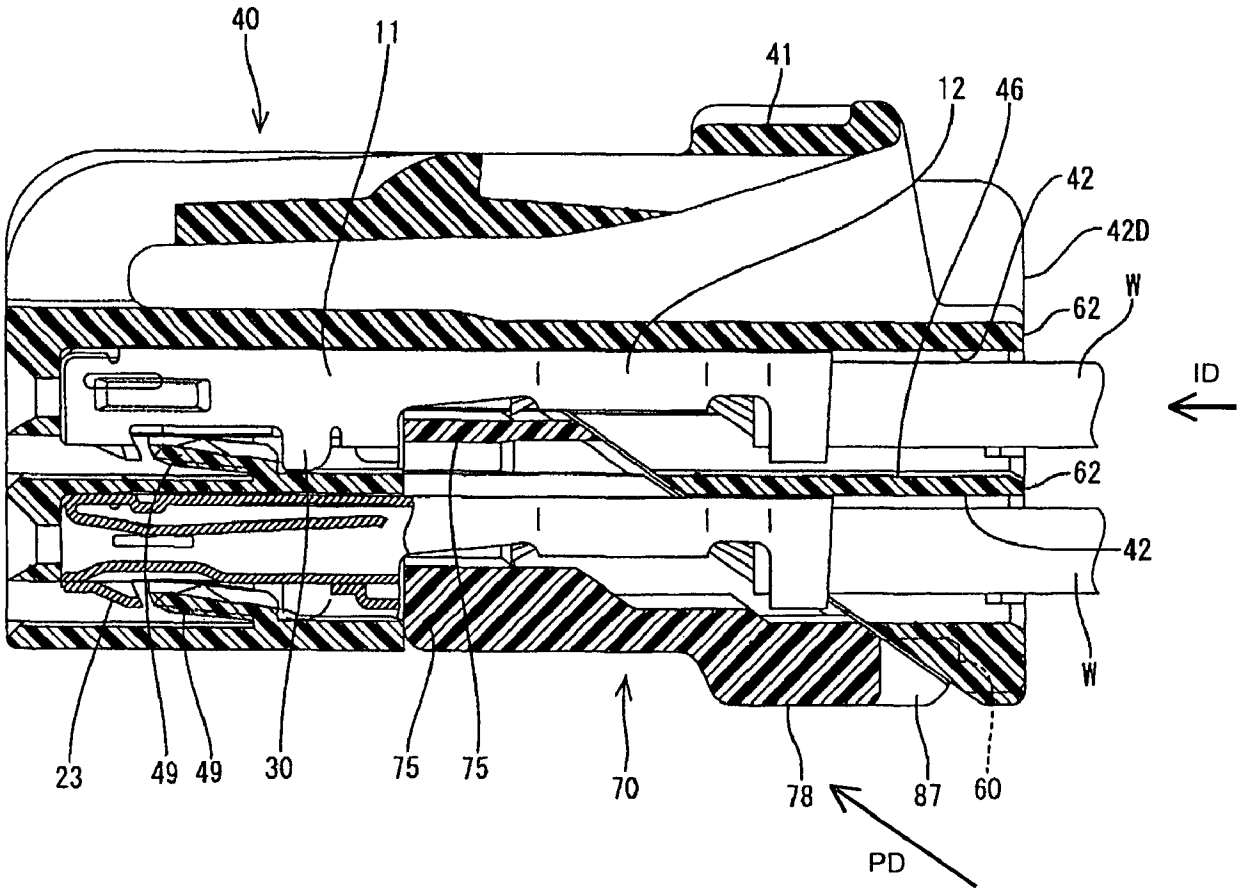
FIG. 15 is a section showing a state where the female terminal fittings are accommodated in the cavities.

Locking sections 75 are formed at the front ends of the bottom surfaces of the windows 74 and on the upper surface of the base 71 for engaging the locking steps 26 of the female terminal fittings 10. The upper and lower locking sections 75 are substantially flush with the bottom walls 43 of the corresponding cavities 42, as shown in FIG. 14, when the retainer 70 is at the partial locking position, thereby enabling insertion and withdrawal of the female terminal fittings 10. However, the locking sections 75 enter the corresponding cavities 42 from the side of the retainer mount hole 51, as shown in FIG. 15, when the retainer 70 is moved in the pushing direction PD to the full locking position thereby engaging the locking steps 26 of the terminal fittings 10.

Stabilizer fitting recesses 76 penetrate the retainer 70 in forward and backward directions and can receive the stabilizers 30 of the female terminal fittings 10 inserted into the cavities 42. The stabilizer fitting recesses 76 are at the left corners of the bottom walls 74*a* and the upper surfaces of the ceiling walls 74*b* of the respective windows 74, as shown in FIG. 9, and align with the stabilizer insertion grooves 46 to permit passage of the stabilizers 30 when the retainer 70 is at the partial locking position.

The side plates 72 are spaced to hold opposite outer side surfaces of the female housing 40 and are resiliently deformable away from these side surfaces. The side plates 72 close the side openings of the retainer mount hole 51 when the retainer 70 reaches the full locking position, and have a size to face a specified range of the corresponding stepped surface 47. Further, the side plates 42 have a thickness substantially equal to a level difference between the stepped surfaces 47 and the outer side surfaces of the female housing 40. Thus, the side plates 72 are substantially flush with the outer side surfaces of the female housing 40 when the retainer 70 is at the full locking position and define part of the outer walls of sides of the female housing 40.

Figure 12:
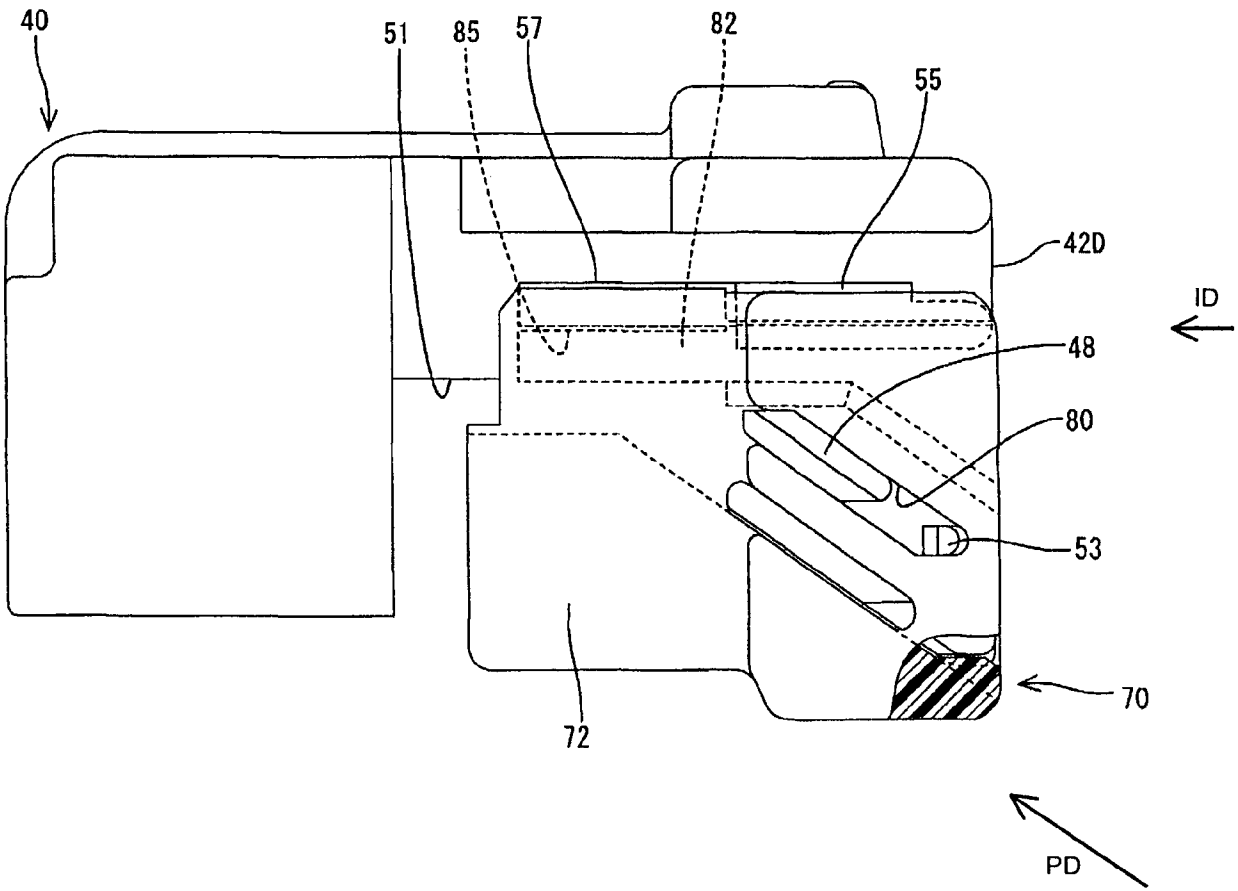
FIG. 12 is a side view showing a partly locked state of the retainer.

Guiding grooves 80 are formed at the rear sides of the side plates 72 for guiding the retainer 70 between the partial and full locking positions. The guiding grooves 80 have the substantially same inclination as the rear opening edges of the respective cavities 42 of the female housing 40 and substantially parallel the pushing direction PD. Additionally the guiding grooves 80 have widths so that the locking projections 48 can be accommodated therein. As shown in FIG. 12, each guiding groove 80 is engageable with the corresponding locking projection 48 and push-in preventing projection 53 at its opposite ends, and the retainer 70 is held at the partial locking position in such a state. On the other hand, the locking projections 48 move towards the bottom ends of the guiding grooves 80 when the retainer 70 is pushed up in the pushing direction PD (see FIG. 12) along the guiding grooves 80 so that the retainer 70 is fully locked.

In this fully locked state, the retainer 70 is locked at the following two portions. Specifically, a locking claw 85 is formed to project inward at the upper end of the inner surface of each side plate 72. The locking claws 85 substantially face the catching pieces 57 of the housing 40 at substantially the same height when the retainer 70 is at the partial locking position (see FIG. 12), the locking claws 85 move beyond the slanted surfaces 58 of the catching pieces 57 and engage the upper edges of the catching pieces 57 when the retainer 70 is moved to the full locking position.

Figure 13:
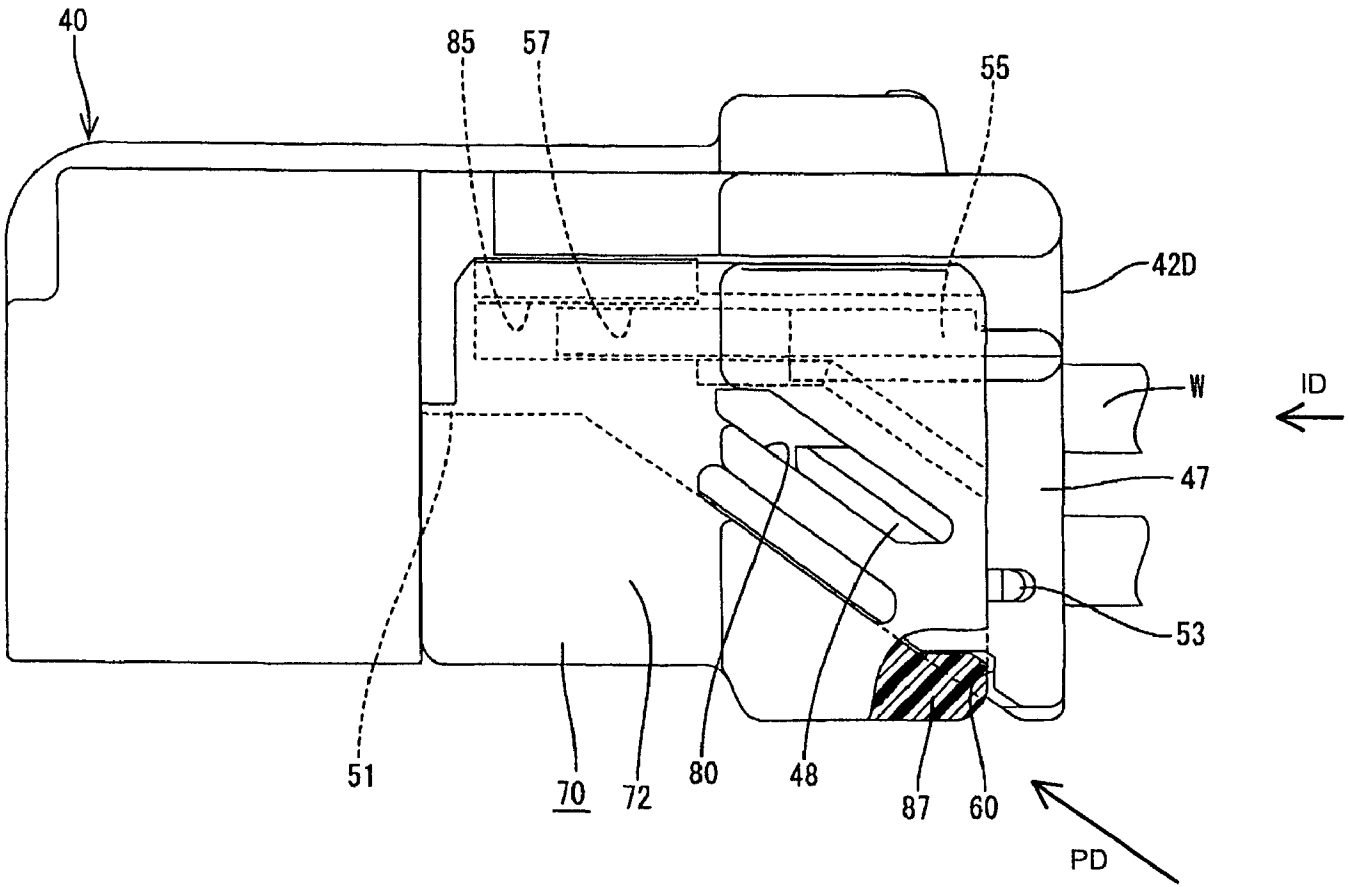
FIG. 13 is a side view showing a fully locked state of the retainer.

Lock projections 87 are formed at the opposite widthwise ends of the inclined rear surface of the base 71 of the retainer 70, as shown in FIGS. 11 and 13. The upper surface of each lock projection 87 is substantially horizontal and parallel to the insertion direction ID. The rear surface of each locking projection 87 is substantially vertical and normal to the insertion direction ID. Additionally, a corner between these surfaces is chamfered. The lock projections 87 wait on standby obliquely below from the rear side of the lock holes 60, as shown in FIG. 1, when the retainer 70 is at the partial locking position, whereas the lock projections 87 fit into the lock holes 60, as shown in FIG. 13, to prevent the retainer 70 from coming out backward when the retainer 70 is moved to the full locking position.

Figure 17:
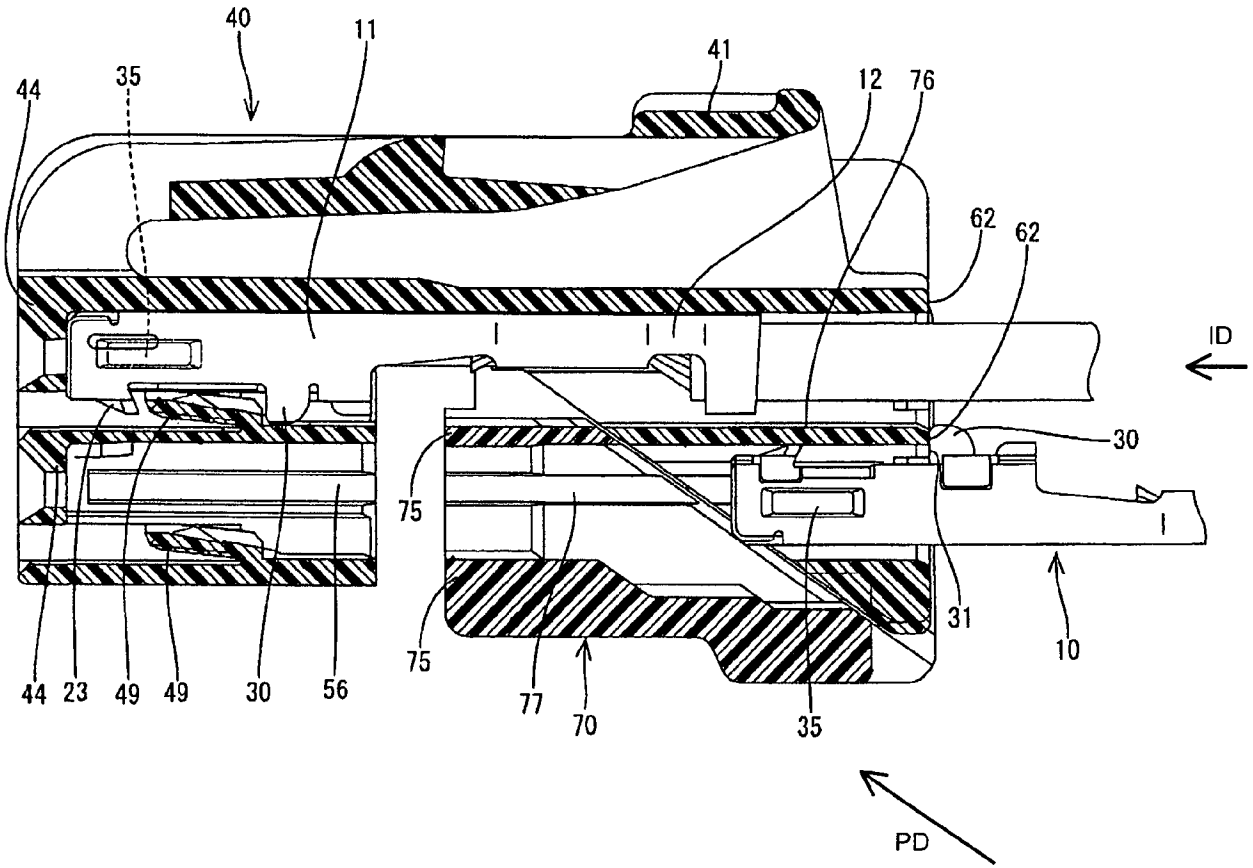
FIG. 17 is a section showing a state where a stabilizer interferes with a restricting portion.
Figure 18:
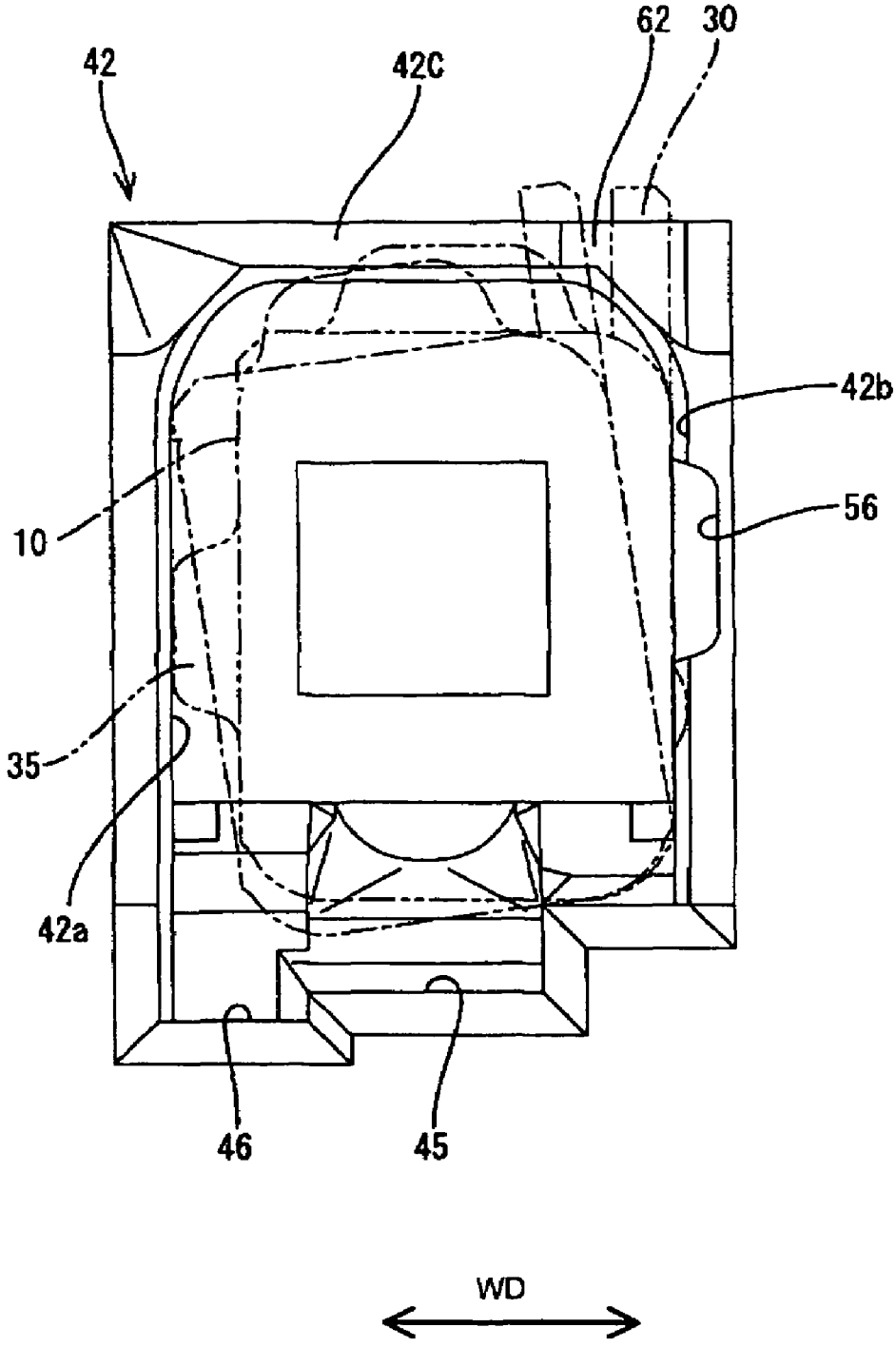
FIG. 18 is a section showing the terminal fitting inserted upside-down.
Figure 19:
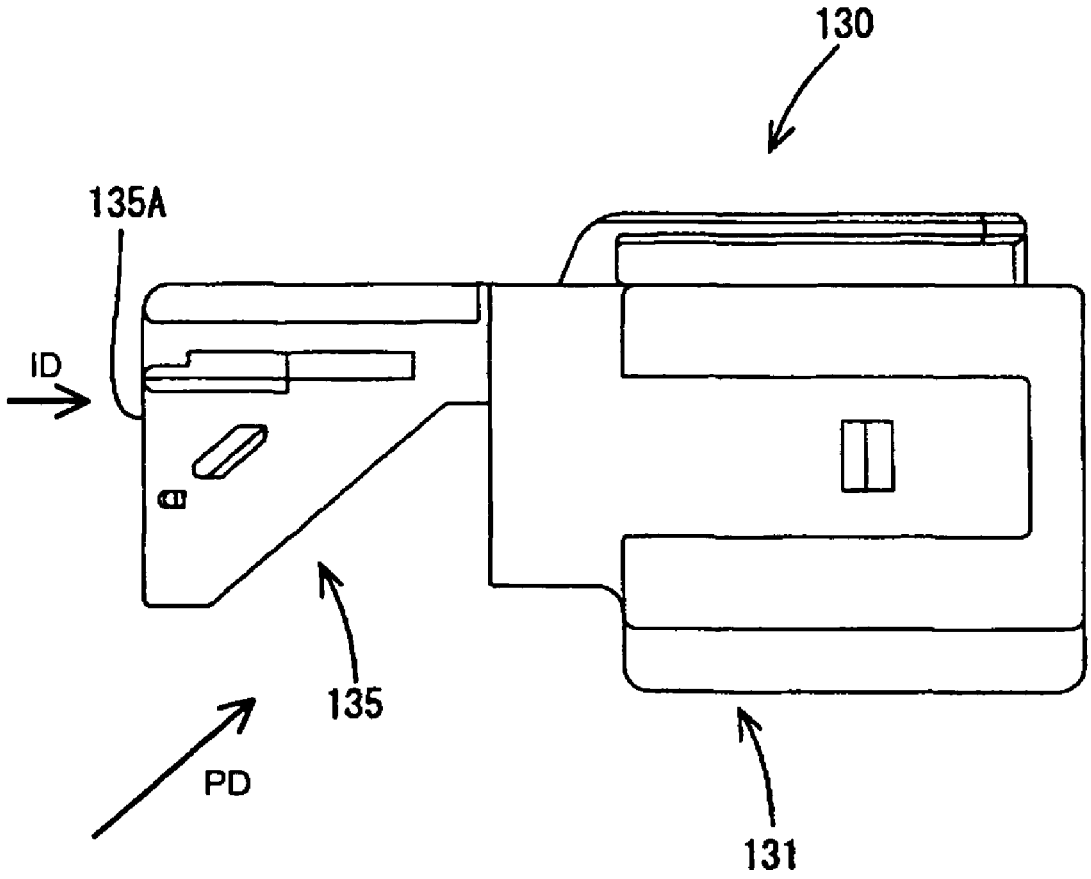
FIG. 19 is a side view of a male connector housing according to a second embodiment of the invention.

Part of the peripheral edge of the opening in a rear end surface 42D of each cavity 42 is slanted to guide the female terminal fitting 10 into the cavity 42. However, a restricting portion 62 is formed on this peripheral edge diagonal to the stabilizer insertion groove 46 and is substantially normal to the insertion direction ID, as shown in FIG. 16. The restricting portion 62 achieves surface contact with the stopper surface 31 of the stabilizer 30, as shown in FIGS. 17 and 18, when the female terminal fitting 10 is inserted in an improper posture, such as upside down into the cavity 42, thereby preventing erroneous insertion.

The female terminal fitting 10 has a posture holding portion 35 to reliably prevent erroneous insertion. The posture holding portion 35 is formed by embossing or cutting and bending the sidewall 15 that faces the sidewall 14 that has the stabilizer 30 to project toward the inner wall of the cavity 42.

As shown in FIG. 4, the posture holding portion 35 is at an intermediate position of the sidewall 15 with respect to the height direction. Additionally, the posture holding portion 35 has a long shape extending along the inserting direction ID of the female terminal fitting 10 and has a substantially uniform width. The front end of the posture holding portion 35 is substantially at the same position along the inserting direction ID as the front holding piece 24, whereas the rear end thereof is substantially in the longitudinal middle of the main body 11 and before the stabilizer 30 with respect to the inserting direction ID. Further, the front end of the posture holding portion 35 is located before the front end of the cut-away portion 21 and the rear end thereof is substantially in the middle of the cut-away portion 21. Thus, the posture holding portion 35 strengthens the front side of the main portion 11.

The posture holding portion 35 has a substantially flat surface 35A connected with the sidewall 15 via slanted surfaces 35 tapered toward the flat surface 35A. A projecting height (dimension A in FIG. 16) of the posture holding portion 35 is substantially equal to or slightly shorter than a dimension obtained by subtracting the width (dimension C in FIG. 16) of the main portion 11 from spacing (dimension B in FIG. 16) along the width direction WD between the opposite inner walls of the cavity 42.

The posture holding portion 35 enters the cavity 42 and contacts the left inner wall 42*a*, i.e. the inner wall 42 adjacent to the stabilizer insertion groove 46 as shown in phantom in FIG. 18, if the female terminal fitting 10 is inserted improperly, e.g. upside down. This prevents the female terminal fitting 10 from being inclined, and the female terminal fitting 10 is held in a posture so that the stopper surface 31 of the stabilizer 30 is substantially normal to the ceiling wall 42*c* of the cavity 42. Therefore, a sufficient amount of interference of the stopper surface 31 of the stabilizer 30 with the restricting portion 62 of the cavity 42 is ensured.

An escaping groove 56 is formed in an intermediate portion of the right inner wall 42*b* of each cavity 42 and extends substantially along the inserting direction ID of the female terminal fitting 10 for accommodating the posture holding portion 35. The escaping grooves 56 are formed over substantially the entire length of the cavities 42 at both upper and lower stages. Thus, the front ends of the escaping grooves 56 are near the front wall 44 of the cavities 42 and the rear ends thereof open in the rear end surfaces 42D of the cavities 42 (see FIG. 1). Accordingly, the posture holding portion 35 enters the escaping groove 56 at each stage when the female terminal fitting 10 is inserted in a proper posture into the cavity 42. Each escaping groove 56 is dimensioned to define a clearance (play) to the posture holding portion 35 in order not to impair the insertion operability of the female terminal fitting 10.

The escaping grooves 56 at the lower stage are divided into front and rear sections by the retainer mount hole 51. An escaping recess 77 having the same shape as the escaping groove 56 is formed at an intermediate portion of the left inner wall of the each window 74 of the retainer 70. The escaping recess 77 is alignable with the escaping groove 56 at the lower stage when the retainer 70 is at the partial locking position shown in FIG. 1.

Upon assembling the connector, the retainer 70 is first held at the partial locking position with respect to the female housing 40. The retainer 70 can be pushed in the pushing direction PD. As a result, both side plates 72 widen to hold the opposite stepped surfaces 47 of the female housing 40, and the locking projections 48 and the push-in preventing projections 53 are fit into the guiding grooves 80, as shown in FIG. 12. The retainer 70 is held at the partial locking position by the engagement of the locking projections 48 and the push-in preventing projections 53 with opposite ends of the guiding grooves 80.

Subsequently, the female terminal fitting 10 is opposed to the cavity 42. In this proper posture, the stabilizer 30 and the posture holding portion 35 of the female terminal fitting 10 face the stabilizer insertion groove 46 and the escaping groove 56 of the cavity 42. Thus, the female terminal fitting 10 can be inserted into the cavity 42 from behind and along the inserting direction ID. Accordingly, the female terminal fitting 10 is inserted into the cavity 42 and the posture holding portion 35 enters the escaping groove 56. The stabilizer 30 enters the stabilizer insertion groove 46 when the entire posture holding portion 35 is accommodated in the cavity 42. Thereafter, the female terminal fitting 10 is inserted farther and is guided by the stabilizer 30 and the stabilizer insertion groove 46. Finally, the main portion 11 passes the retainer 70 and is pushed in while resiliently deforming the lock 49 out and down. The lock 49 is restored resiliently when the locking projection 23 moves beyond the leading end of the lock 49, so that the leading end of the lock 49 engages the rear end of the locking projection 23 to effect partial locking.

The rear end of the female housing 10 is gripped after all of the female terminal fittings 10 have been inserted into the cavities 42, and the retainer 70 is pushed in the pushing direction PD from the partial locking position toward the full locking position. As a result, the portions of the side plates 42 around the bottom ends of the guiding grooves 80 deform resiliently and move onto the push-in preventing projections 53, thereby causing the push-in preventing projections 53 to exit from the guiding grooves 80. Simultaneously, the retainer 70 is pushed obliquely up in the pushing direction PD and is guided by the engagement of the locking projections 48 and the guiding grooves 80.

The upper and lower locking sections 75 enter the cavities 42 in the female housing 40 from below to engage the corresponding locking steps 26 of the female terminal fittings 10 when the retainer 70 reaches the full locking position, as shown in FIG. 15, thereby doubly locking the female terminal fittings 10 in cooperation with the locks 49.

The female terminal fitting 10 may be oriented improperly (e.g. turned upside down) with respect to the cavity 42 during mounting into the female housing 40. In this situation, the posture holding portion 35 of the female terminal fitting 10 enters the cavity 42 and contacts the left inner wall 42*a* of the cavity 42. As a result, as shown in FIG. 18, the female terminal fitting 10 cannot incline in the cavity 42 and the female terminal fitting 10 is held in a posture so that the stopper surface 31 of the stabilizer 30 is substantially normal to the ceiling wall 42*c* of the cavity 42. The stabilizer 30 gradually approaches the rear end surface 42D of the cavity 42 as the female terminal fitting 10 is inserted farther into the cavity 42 in this state. Consequently the stopper surface 31 of the stabilizer 30 contacts the restricting portion 62 of the cavity 42. Further insertion of the female terminal fitting 10 is prevented, and thus an operator can notice that the female terminal fitting 10 is in a wrong inserting posture.

As described above, the posture holding portion 35 contacts the inner wall 42*a* of the cavity 42 if the female terminal fitting 10 is mounted into the female housing 40 while being improperly oriented (e.g. turn upside down), to prevent the female terminal fitting 10 from being inclined in the cavity 42. Thus, the corner of the female terminal fitting 10 will not fall into the stabilizer insertion groove 46 in a way that could reduce mutual interference of the stabilizer 30 and the restricting portion 62 (see phantom line in FIG. 18). Hence, sufficient interference between the stopper surface 31 of the stabilizer 30 and the restricting portion 62 of the cavity 42 is ensured, and the insertion of the female terminal fitting 10 in a wrong posture is prevented with high reliability. On the other hand, if the female terminal fitting 10 is inserted in a proper posture, the posture holding portion 35 is accommodated in the escaping groove 56 in the cavity 42 and does not hinder the insertion.

The inner wall 42*a* has a high degree of freedom in locating the posture holding portion 35 since no recess or projection such as the protrusion insertion groove 45 and the stabilizer insertion groove 46 is formed in or on this inner wall 42*a*.

The inclination of the female terminal fitting 10 and the interference of the stabilizer 30 with the restricting portion 62 would be carried out at the same time if the posture holding portion 35 was at substantially the same position as the stabilizer 30 with respect to the inserting direction ID of the female terminal fitting 10. However, the posture holding portion 35 is before the stabilizer 30 along the inserting direction ID. Thus, the inclination of the female terminal fitting 10 is prevented earlier and the insertion of the female terminal fitting 10 in a wrong posture is prevented with higher reliability.

A second embodiment of the invention is illustrated FIGS. 19 to 23. Although the female connector is shown in the first embodiment, a male connector is shown in the second embodiment. Hereinafter, the respective constructions are briefly described. In the following description, a mating side with an (unillustrated) mating connector (right side in each figure) is referred to as front side.

Figure 22:
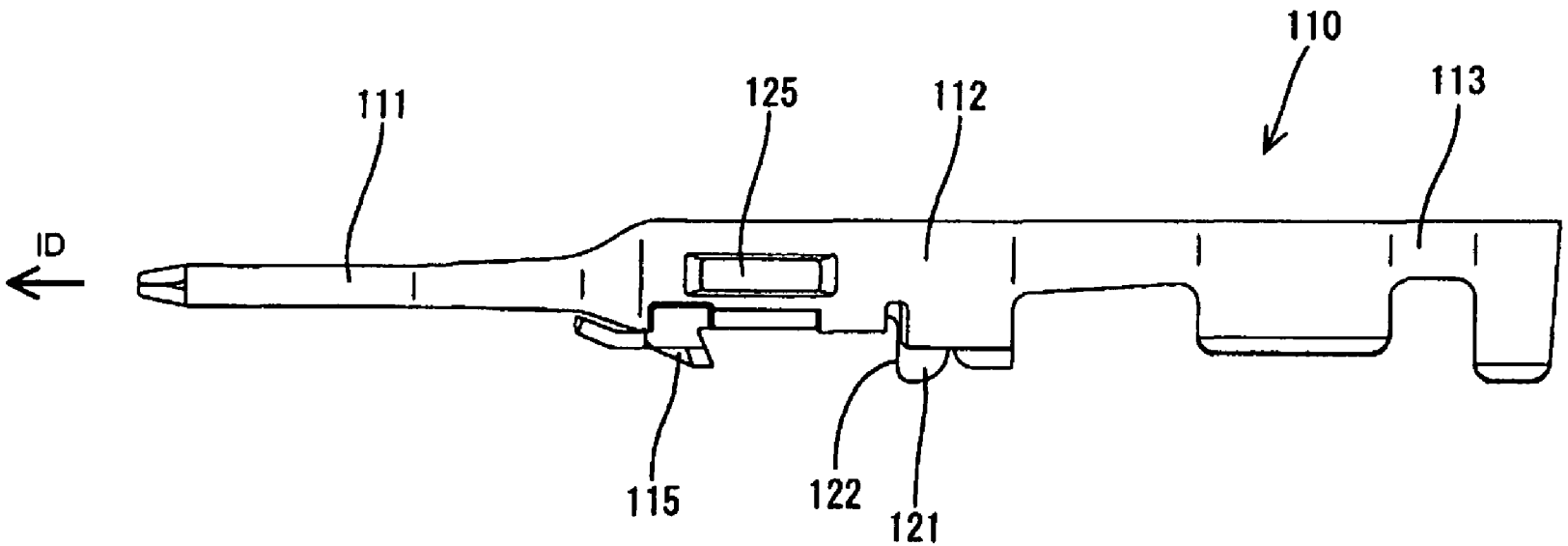
FIG. 22 is a side view of a male terminal fitting.
Figure 23:
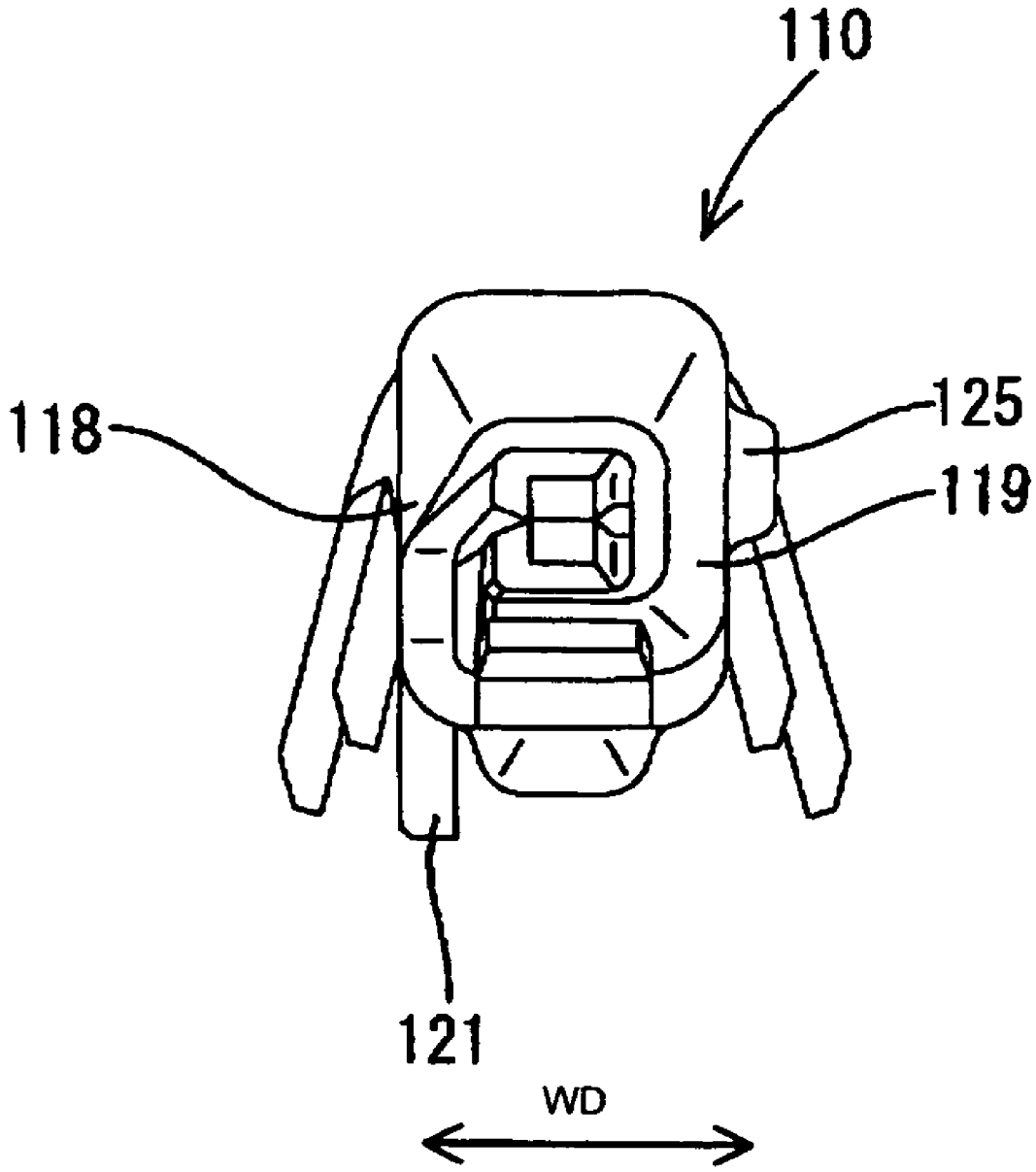
FIG. 23 is a front view of the male terminal fitting.
Figure 24A:
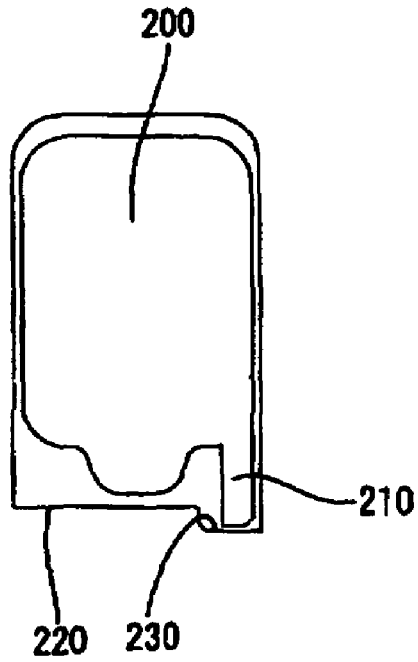
FIG. 24(a) PRIOR ART
FIGS. 24(*a*) and 24(*b*) are diagrams showing a prior art.
Figure 24B:
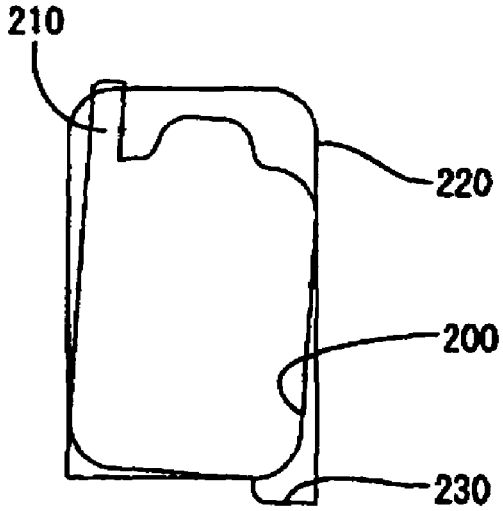
FIG. 24(b) PRIOR ART

A male terminal fitting 110, as shown in FIG. 22, has a tab 111 to be electrically connected with a mating female terminal fitting, a substantially box-shaped main portion 112 and a barrel 113 to be crimped, bent or folded into connection with an end of a wire W. The tab 111 is formed by folding a plate piece that is narrow and long in forward and backward directions and extending from the front edge of the main body 112 back along a longitudinal direction so that two pieces are held in close contact with each other.

The bottom surface of the main body 112 is embossed substantially in the longitudinal middle to project out and down to form a locking projection 115. A stabilizer 121 projects out and down from the bottom end of the left surface of the main body 112 shown in FIG. 23 similar to the female terminal fitting 10 of the first embodiment. A stopper surface 122 is defined at the front of the stabilizer 121 and is substantially straight along the vertical direction and normal to the inserting direction ID. A posture holding portion 125 projects out from the right surface 119 shown in FIG. 23. Similar to the first embodiment, the posture holding portion 125 has a laterally long shape substantially along the inserting direction ID of the male terminal fitting 110 and is before or partly overlapping the stabilizer 121 with respect to this inserting direction ID.

Figure 21:
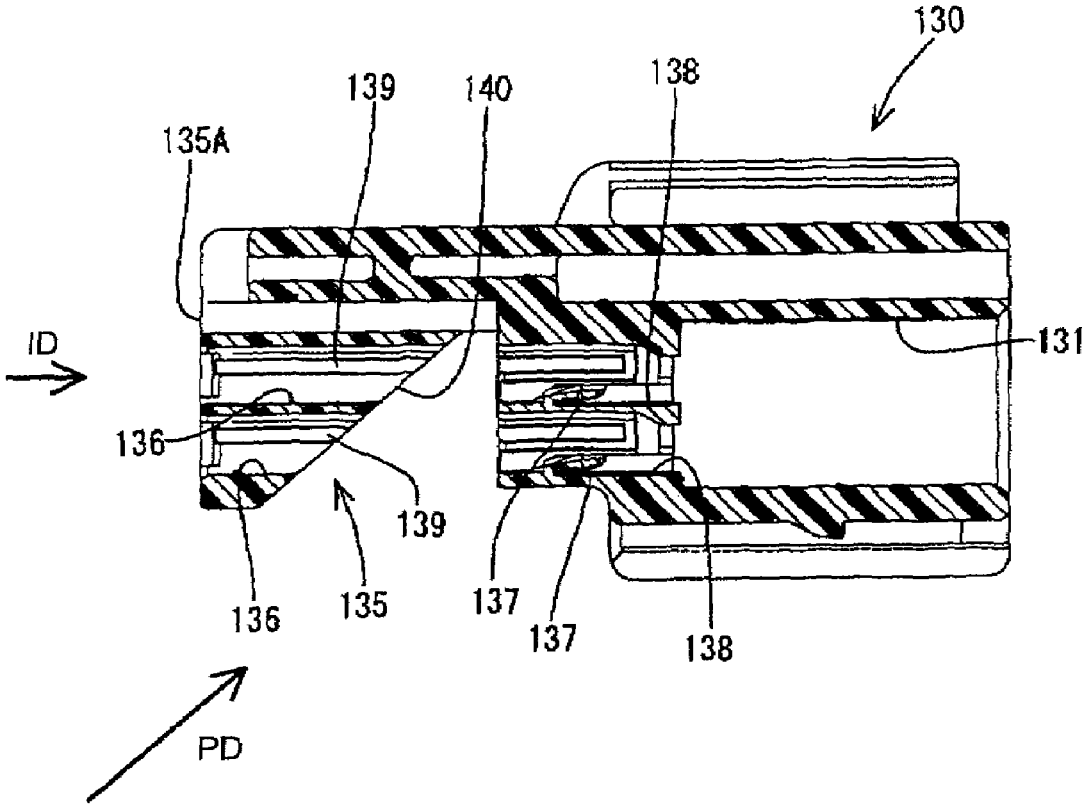
FIG. 21 is a section of the male connector housing.

The male housing 130, as shown in FIG. 21, has a receptacle 131 into which a mating female connector is fittable and a terminal-accommodating portion 135. The terminal-accommodating portion 135 is a wide block, and cavities 136 are provided therein for receiving the male terminal fittings 110 from behind and along the inserting direction ID. The cavities 136 penetrate the male housing 130 along forward and backward directions, and a plurality of them are arranged in a widthwise direction WD at upper and lower stages. A resiliently deflectable lock 137 is provided at the bottom surface of each cavity 136 for engaging the male terminal fitting 110.

Figure 20:
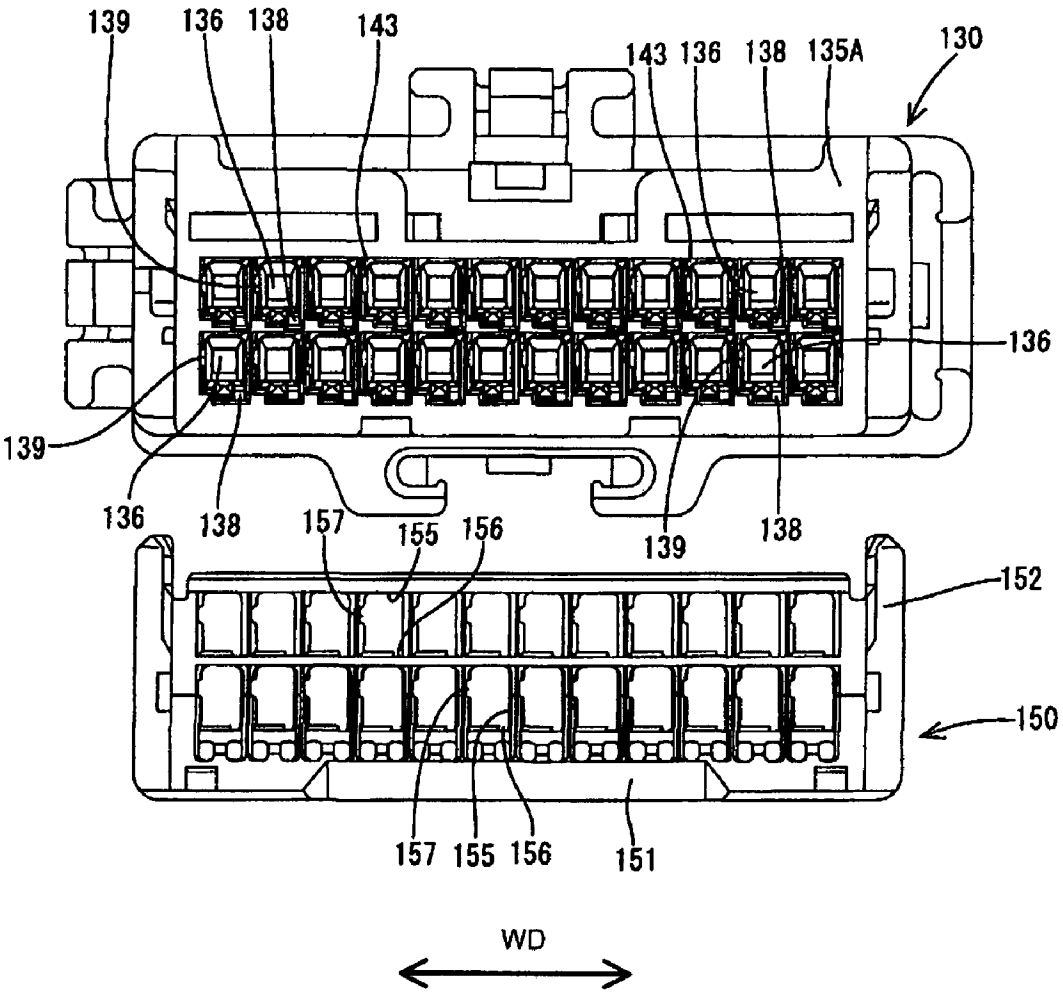
FIG. 20 is a rear view of the male connector housing.

A stabilizer insertion groove 138 is formed at the right corner of the bottom wall of each cavity 136, as shown in FIGS. 20 and 21, and extends along the inserting direction ID of the male terminal fitting 110 for receiving the stabilizer 121. The front end of the stabilizer insertion groove 138 reaches the base end of the lock 137 and the rear end thereof is open. An escaping groove 139 is formed in the left inner wall of each cavity 136 for receiving the posture holding portion 125. The escaping groove 139 also extends along the inserting direction ID of the male terminal fitting 110. The front end of escape groove 139 reaches the leading end of the lock 137 and the rear end thereof is open. A retainer mount hole 140 is formed in outer peripheral surfaces of the terminal accommodating portion 135 and is used to mount a retainer 150 in a pushing direction PD. Similar to the first embodiment, a restricting portion 143 for the stabilizer 121 is provided at the opening edge in a rear end surface 135A of each cavity 136 diagonal to the stabilizer insertion groove 138.

The retainer 150 has a main body 151 that is fittable into the retainer mount hole 140 and a pair of side plates 152 that bulge out from opposite widthwise ends of the retainer main body 151. The retainer 150 is displaceable between a partial locking position (not shown) where insertion of the male terminal fittings 110 into the cavities 136 is permitted and a full locking position (not shown) where the male terminal fittings 110 are locked by the retainer 137.

As shown in FIG. 20, the retainer main body 151 has windows 155 arranged at upper and lower stages. The windows 155 align substantially with the respective upper and lower cavities 136 of the male housing 130. A stabilizer fitting recess 156 is formed in the bottom surface of each window 156 at each of the upper and second lower stages for receiving the stabilizer 121 and an escaping recess 157 is formed in the left inner wall of each window 155 for receiving the posture holding portion 125. The recesses 156, 157 penetrate the retainer 150 along forward and backward directions. The stabilizer fitting recesses 156 align with the stabilizer insertion grooves 138 of the cavities 136 and the escaping recesses 157 align with the escaping grooves 139 of the cavities 136 when the retainer 150 is at the partial locking position.

The male connector of the second embodiment has the same effects as the female connector of the first embodiment. Specifically, the posture holding portion 125 prevents inclination of the male terminal fitting 110 in the cavity 136 even if the male terminal fitting 110 is mounted while being oriented improperly (e.g. upside down).

Insertion of the male terminal fitting 110 in a wrong posture can be prevented with higher reliability because a sufficient amount of interference of the stopper surface 122 of the stabilizer 121 with the restricting portion 143 of the cavity 136 is ensured. On the other hand, the posture holding portion 125 is accommodated in the escaping groove 139 of the cavity 136 and does not hinder the proper insertion if the male terminal fitting 110 is in a proper posture.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The posture holding portion 35, 125 is before the stabilizer 30, 120 with respect to the inserting direction ID of the terminal fitting 10, 110 in the first and second embodiments. However, they may be at the same position.

The posture holding portion 35, 125 is on the sidewall 15 substantially facing the sidewall 14 provided with the stabilizer 30, 120 in the first and second embodiments. However, it may be on another side surface unless it contact the inner wall where the restricting portion 62 is formed when the terminal fitting 10, 110 is mounted upside down.

Even though the invention has been described with reference to connectors having a retainer for doubly locking the terminal fittings in the respective cavities, it should be understood that the invention is also applicable to connectors having no retainer.

What is claimed is:

1. A connector, comprising:

at least one terminal fitting, a housing with at least one cavity for accommodating the terminal fitting, and a guiding groove at a corner of an inner wall of the cavity and extending substantially along an inserting direction of the terminal fitting wherein:

a side surface of the terminal fitting has a stabilizer for engaging the guiding groove and guiding the terminal fitting into the cavity when the terminal fitting is oriented properly and for interfering with an opening edge of the cavity at a side diagonal to the guiding groove to prevent insertion of the terminal fitting into the cavity when the terminal fitting is oriented improperly, and a posture holding portion is formed at a side surface of the terminal fitting other than the side surface intersecting a base end of the stabilizer, the posture holding portion bulging out toward the inner wall of the cavity at a position at or before the stabilizer with respect to the inserting direction of the terminal fitting, the posture holding portion contacting the inner wall of the cavity when the terminal fitting is oriented improperly thereby preventing the terminal fitting from falling into the guiding groove and inclining.

2. The connector of claim 1, wherein an escaping groove is formed in the inner wall of the cavity and extends substantially along the inserting direction for accommodating the posture holding portion when the terminal fitting is oriented properly.

3. The connector of claim 1, wherein the cavity is a substantially rectangular tube, the posture holding portion contacting an inner wall of the cavity at a side adjacent to the guiding groove when the terminal fitting is oriented improperly with respect to the cavity.

4. The connector of claim 1, wherein a front portion of the stabilizer along the inserting direction is substantially normal to the inserting direction and a rear portion of the stabilizer along the inserting direction is rounded with respect to the inserting direction.

5. The connector of claim 1, wherein one side of the terminal fitting has a cut-away portion for engaging a lock of the housing, the stabilizer extending rearward from the cut-away portion.

6. The connector of claim 1, wherein one side of the terminal fitting has a locking projection for engaging a lock of the housing, the height of the stabilizer being larger than the height of the locking projection.

7. The connector of claim 1, wherein the terminal fitting has a main portion, a bead projecting out on leading end of a side wall of the main portion and extending substantially forward and backward for reinforcing the main portion.

8. A connector, comprising:

a housing with opposite front and rear ends and at least one cavity extending between the ends, the cavity being of substantially rectangular cross-section and having first and second opposed substantially parallel surfaces and third and fourth opposed substantially parallel surfaces extending between the first and second surfaces, a guiding groove at a corner of the cavity defined by the first and third surfaces and extending from the rear end of the housing towards the front end, an escaping groove formed in the second surface of the cavity and extending from the rear end of the housing towards the front end; and a terminal fitting having opposite front and rear ends and a main body with a substantially rectangular cross-section configured for insertion into the rear end of the cavity, a stabilizer projecting from the main body and disposed for sliding insertion into the guiding groove when the terminal fitting is in a selected orientation relative to the cavity and a posture holding portion projecting from the main body and disposed for sliding insertion into the escaping groove when the terminal fitting is in the selected orientation relative to the cavity.

9. The connector of claim 8, wherein a distance from the front end of the terminal fitting to the posture holding portion is less than a distance from the front end of the terminal fitting to the stabilizer.

10. A terminal fitting to be inserted into a cavity of a housing, a guiding groove formed at a corner of an inner wall of the cavity, wherein:

a side surface of the terminal fitting has a stabilizer for guiding insertion of the terminal fitting into the cavity by engaging the guiding groove when the terminal fitting is oriented properly, the stabilizer interfering with an opening edge of the cavity at a side diagonal to the guiding groove for preventing insertion of an improperly oriented terminal fitting into the cavity, and a posture holding portion is formed at a side surface of the terminal fitting other than the side surface intersecting a base end of the stabilizer, the posture holding portion bulging out toward the inner wall of the cavity at a position at or before the stabilizer with respect to the inserting direction of the terminal fitting, the posture holding portion contacting the inner wall of the cavity when the terminal fitting is oriented improperly for insertion into the cavity, thereby preventing the terminal fitting from falling into the guiding groove and inclining.

11. The terminal fitting of claim 10, wherein a front portion of the stabilizer along the inserting direction is substantially normal to the inserting direction and a rear portion of the stabilizer along the inserting direction is rounded with respect to the inserting direction.

12. The terminal fitting of claim 10, wherein one side of the terminal fitting has a cut-away portion for engaging a lock of the housing, the stabilizer extending rearward from the cut-away portion.

13. The terminal fitting claim 10, wherein one side of the terminal fitting has a locking projection for engaging a lock of the housing, the height of the stabilizer being larger than the height of the locking projection.

14. The terminal fitting of claim 10, wherein the terminal fitting comprises a main portion, a bead projecting out on leading end of a side wall of the main portion and extending substantially forward and backward for reinforcing the main portion.

15. A terminal fitting having a front end and a substantially rectangular tubular main body substantially adjacent the front end, a stabilizer projecting out from the main body substantially at a corner defined by first and second intersecting surfaces of the main body, and a posture holding portion projecting out from a third surface of the main body at a position before the stabilizer with respect to the front end of the terminal fitting.

16. The terminal fitting of claim 15, wherein a front edge of the stabilizer is substantially normal to a line defined by the corner between the first and second surfaces.

17. The terminal fitting of claim 16, further comprising a reinforcing bead projecting out on the main portion at a position substantially opposite the posture holding portion.

* * * * *